US005697034A

United States Patent [19]

Iwakura et al.

[11] Patent Number: 5,697,034

[45] Date of Patent: Dec. 9, 1997

[54] IMAGE FORMING APPARATUS WHICH STABLY HOLDS A UNIFORM SURFACE POTENTIAL OF A TRANSFER DEVICE

[75] Inventors: Yoshie Iwakura, Narashino; Takuya Abe, Yokote; Kiyoshi Toizumi; Fumio Shimazu, both of Yamatokoriyama, all of Japan

[73] Assignee: Sharp Kabushiki Kaisha, Osaka, Japan

[21] Appl. No.: 630,982

[22] Filed: Apr. 12, 1996

[30] Foreign Application Priority Data

| | | | |
|---|---|---|---|
| Apr. 14, 1995 | [JP] | Japan | 7-089689 |
| Jul. 11, 1995 | [JP] | Japan | 7-175199 |
| Mar. 22, 1996 | [JP] | Japan | 8-066942 |

[51] Int. Cl.[6] ..... G03G 15/16

[52] U.S. Cl. ..... 399/313; 399/297

[58] Field of Search ..... 355/271, 272, 355/273, 274, 277, 203, 208; 399/44, 66, 297, 310, 312, 313, 314, 315, 318, 303

[56] References Cited

U.S. PATENT DOCUMENTS

| | | |
|---|---|---|
| 3,837,741 | 9/1974 | Spencer . |
| 5,113,226 | 5/1992 | Tadokoro et al. . |
| 5,119,141 | 6/1992 | Bhagat . |
| 5,220,386 | 6/1993 | Aoki et al. . |
| 5,239,347 | 8/1993 | Onodera et al. . |
| 5,300,984 | 4/1994 | Fuma et al. . |
| 5,390,012 | 2/1995 | Miyashiro et al. . |
| 5,416,565 | 5/1995 | Noda . |

FOREIGN PATENT DOCUMENTS

| | | |
|---|---|---|
| 2-74975 | of 1990 | Japan . |
| 5-173435 | of 1993 | Japan . |

*Primary Examiner*—Sandra L. Brase

[57] ABSTRACT

An image forming apparatus has a photoreceptor drum whereon a toner image is to be formed, a transfer drum for transferring the toner image to a transfer material by making the transfer material contact with the photoreceptor drum, the transfer drum having a dielectric layer, semiconducting layer and conducting layer laminated in this order from a surface which comes into contact with the transfer material, a power source section for applying any voltage to the conducting layer, and a grounded conducting roller which is located in an upstream section in a transfer material transporting direction with respect to a transfer position on a surface of the dielectric layer and comes into contact with the dielectric layer surface through the transfer material. The volume resistivity of the dielectric layer is not lower than 40 percent of the volume resistivity of the semiconducting layer. In this structure, a current component flowing in the circuit is greater than a current component causing the dielectric layer to function as a power source, thereby accumulating charges on the dielectric layer. As a result, stable adhesion of the transfer material to the transfer drum, and improved image quality are achieved.

30 Claims, 19 Drawing Sheets

IMAGE FORMING APPARATUS WHICH STABLY HOLDS A UNIFORM SURFACE POTENTIAL OF A TRANSFER DEVICE

FIELD OF THE INVENTION

The present invention relates to an image forming apparatus for use in such devices as laser printers, copying machines and laser facsimile machines.

BACKGROUND OF THE INVENTION

A conventional image forming apparatus performs development by adhering toner to an electrostatic latent image formed on a photoreceptor drum, and transfers the resulting toner image to a transfer material wound on a transfer drum.

In such an image forming apparatus, for example, as illustrated in FIG. 26, a corona charger 102 and a corona charger 104 are separately disposed inside a cylinder 101 having a dielectric layer 101*a*. The corona charger 102 is used for attracting a transfer material P, and the corona charger 104 is used for a transfer of a toner image formed on a surface of a photoreceptor drum 103 to the transfer material P. Namely, attracting the transfer material P and the transfer operation are separately performed by the chargers 102 and 104, respectively.

As illustrated in FIG. 27, another conventional image forming apparatus includes a cylinder 201 having a two-layer structure, i.e., a semiconductor layer 201*a* as an outer layer and a base member 201*b* as an inner layer, and a grip mechanism 202 for holding a transported transfer material P along the cylinder 201. In this image forming apparatus, the grip mechanism 202 grips an end of the transported transfer material P to lay the transfer material P along the surface of the cylinder 201. The toner image on the photoreceptor drum 103 is then transferred to the transfer material P by charging the surface of the cylinder 201 with an application of a voltage to the outer layer of the cylinder 201, i.e., the semiconductor layer 201*a*, or performing discharge with a charger in the cylinder 201.

However, in the image forming apparatus of FIG. 26, since the cylinder 101 as a transfer roller has a single-layer structure formed only by a dielectric layer 101*a*, it is necessary to provide the corona chargers 102 and 104 therein. Such a requirement imposes a restriction on the size of cylinder 101, preventing a reduction in the size of the apparatus.

Moreover, in the image forming apparatus of FIG. 27, by constructing the cylinder 201 as a transfer roller to have a two-layer structure, charging of the cylinder 201 for transferring the toner image to the transfer material P is carried out with a reduced number of chargers. However, since the image forming apparatus has the grip mechanism 202, the entire structure of the apparatus is complicated. Therefore, the total number of parts used in the apparatus increases, resulting in a rise in the manufacturing cost of the apparatus.

In order to solve the above problems, for example, Japanese Publication for Unexamined Patent Application No. 74975/1990 (Tokukaihei 2-74975) discloses an image forming apparatus having a corona charger that is driven by a unipolar power source and disposed in the vicinity of a separation position where a transfer material is separated from a transfer drum that is formed by laminating conducting rubber and a dielectric film on a grounded metallic roll. In this image forming apparatus, by inducing charges on the dielectric film with the corona charger, the transfer material adheres to the transfer drum. Additionally, when the transfer material adheres to the transfer drum, charges are further induced, and a transfer is performed.

In the image forming apparatus, since the transfer material adheres to the transfer drum due to charges induced on the surface of the transfer drum by a single charger and then a transfer is performed, only one charger is required, thereby reducing the size of the transfer drum. Moreover, the image forming apparatus does not require such a mechanism as the grip mechanism 202 for holding the transfer material, and adheres the transfer material to the transfer drum with a simplified structure.

However, in the image forming apparatus disclosed in Japanese Publication for Unexamined Patent Application No. 74975/1990, the charging of the surface of the transfer drum is carried out by atmospheric discharge of the corona charger. Therefore, when performing color printing, i.e., when performing a transfer process more than once, charges are supplied by the corona charger every time a transfer is executed. It is thus necessary to provide a charger unit including a unipolar power source for controlling the driving of the corona charger, resulting in an increase in the number of component parts of the apparatus. Consequently, the manufacturing cost of the apparatus rises.

Furthermore, Japanese Publication for Unexamined Patent Application No. 173435/1993 (Tokukaihei 5-173435) discloses an image forming apparatus that is provided with a transfer drum having at least a resilient layer made of a foam body and a dielectric layer covering the resilient layer. This image forming apparatus forms a color image on a transfer material in the following manner. Toner images in more than one color are formed on a photoreceptor drum, successively transferred to the transfer material adhering to the transfer drum, and superimposed to form a color image.

In the image forming apparatus disclosed in Japanese Publication for Unexamined Patent Application No. 173435/1993, a cavity section is produced between the resilient layer and the dielectric layer in order to improve the adhesion power, i.e., the adhesion of the transfer material to the transfer drum. By applying a voltage to an adhesion roller as charge inducing means disposed in the proximity of the transfer drum, charges are induced in the cavity section by discharge so as to electrostatically adhere the transfer material to the dielectric layer. Considering the effects of temperature and humidity, and cleaning, the volume resistivity of the dielectric layer is set within a range of from $10^{12}\Omega\cdot$cm to $10^{17}\Omega\cdot$cm. Moreover, the volume resistivity of the resilient layer is set within a range of from $10^{6}\Omega\cdot$cm to $10^{17}\Omega\cdot$cm so that the charges are sufficiently removed to separate the transfer material from the transfer drum.

However, the above image forming apparatus is not restricted in terms of a combination of the volume resistivity of the dielectric layer and that of the resilient layer (foam body layer) and the method for fixing the dielectric layer and the resilient layer. Therefore, even if the volume resistivity of the dielectric layer is much lower than that of the resilient layer, for example, even if the volume resistivity of the dielectric layer is $10^{12}\Omega\cdot$cm and that of the resilient layer is $10^{17}\Omega\cdot$cm, it is possible to form an image.

However, if the volume resistivity of the dielectric layer is much lower than that of the resilient layer, the charges cannot be efficiently induced on the transfer material. Consequently, the electrostatic adhesion of the transfer material to the transfer drum is weakened, and the transfer material separates from the transfer drum before the toner images in the respective colors are completely transferred from the photoreceptor drum surface to the transfer material in color printing, preventing a satisfactory transfer.

Additionally, in the image forming apparatus, the resilient layer is formed by winding a resilient sheet made of urethan foam around an aluminum cylinder and the dielectric layer is formed by winding a dielectric sheet made of PVDF (polyvinylidene fluoride) around the resilient layer so as to produce cavities between the resilient layer and the dielectric layer.

However, in this image forming apparatus, a large number of cavities are produced between the resilient layer and the dielectric layer because only the resilient sheet made of urethan foam is wound around the aluminum cylinder. Such cavities interfere with the movement of charges from the resilient layer to the dielectric layer, causing a possibility of lowering the electrostatic adhesion of the transfer material to the transfer drum. More specifically, since the resilient layer is an aggregated material of urethan foam, cavities are produced between urethane foam particles. Such cavities remain even after covering the resilient layer with the dielectric layer. The volume and the density of the cavities are not uniform. Namely, the cavities cannot be provided in a uniform manner.

Thus, the cavities weaken the electrostatic adhesion of the transfer material to the transfer drum. Consequently, the image forming apparatus cannot achieve stable electrostatic adhesion. In order to solve such a problem, there is a demand for a transfer technique capable of improving the electrostatic adhesion without providing cavities between the resilient layer and the dielectric layer.

Moreover, the image forming apparatus requires at least two power sources. One of the power sources is used for the adhesion roller to adhere the transfer material to the transfer drum. The other power source is used to apply to the transfer material a voltage whose polarity is opposite to the polarity of the toner in transferring the toner image to the transfer material wound around the transfer drum. Consequently, the number of parts constituting the apparatus increases, resulting in a rise in the manufacturing cost of the apparatus. In addition, if the surface of the transfer drum has a scratch, the area of an electric field becomes smaller when charging is performed by atmospheric discharge. As a result, the balance of the electric field is lost at the scratched portion, and an unsatisfactory transfer occurs, for example, a white missing section is produced, at the scratched portion. Therefore, the image quality is lowered.

Furthermore, in the image forming apparatus, since the surface of the transfer roller is charged by atmospheric discharge, a high voltage is applied for charging, and the driving energy of the image forming apparatus increases. Additionally, since the atmospheric discharge is greatly influenced by the environment such as the temperature and humidity of air, the surface potential of the transfer roller tends to vary. As a result, an adhesion defect of the transfer material and disorderly printing may occur.

It is known that the transfer efficiency varies depending on the types of transfer materials even when the same voltage is applied. Specifically, for example, when the transfer material is an OHP sheet of synthetic resin, even if the applied voltage is high, the transfer efficiency is high. However, when the transfer material is paper, if the applied voltage is too high, the transfer efficiency deteriorates. Besides, since the transfer efficiency varies depending on the humidity, it is necessary to control the applied voltage according to the humidity in order to perform an efficient transfer.

SUMMARY OF THE INVENTION

It is an object of the present invention to provide an image forming apparatus capable of forming a high-quality image on a transfer material with a simplified structure by stably holding a uniform surface potential of a transfer device such as a transfer drum to prevent unsatisfactory adhesion of the transfer material to the transfer device and an unsatisfactory transfer of a toner image to the transfer material.

In order to achieve the above object, an image forming apparatus of the present invention includes:

an image carrying body (for example, a photoreceptor drum) on which a toner image is to be formed;

transferring means (for example, a transfer drum) for transferring a toner image formed on the image carrying body to a transfer material by bringing the transfer material into contact with the image carrying body, the transferring means having a dielectric layer made of, for example, polyvinylidene fluoride, a semiconducting layer made of, for example, urethane foam, and a conducting layer made of, for example, aluminum, laminated in this order from a contact side of the transfer material which comes into contact with the transfer material;

voltage applying means (for example, a power source section), connected to the conducting layer, for applying a predetermined voltage to the conducting layer; and potential difference generating means (for example, a conducting roller) which is grounded, disposed in an upstream section in the transporting direction of the transfer material with respect to a transfer position on the surface of the dielectric layer and comes into contact with the surface of the dielectric layer through the transfer material, wherein the volume resistivity of the dielectric layer is not lower than 40 percent of the volume resistivity of the semiconducting layer.

In this structure, since the electrode member that is grounded, disposed in an upstream section in the transporting direction of the transfer material with respect to a transfer position on the surface of the dielectric layer and comes into contact with the surface of the dielectric layer through the transfer material, charges having the same polarity as that of a voltage applied to the conducing layer accumulate on the semiconducting layer. Charges of the same polarity are also induced on the dielectric layer and the surface of the transfer material pressed against the surface of the dielectric layer. Namely, charges whose polarity is opposite to that of the voltage applied to the conducting layer are induced on the back surface of the transfer material that is in contact with the dielectric layer. It is therefore possible to cause the transfer material to adhere to the surface of the dielectric layer, i.e., the surface of the transferring means by electrostatic adhesion by simply applying the voltage to the conducting layer. Moreover, the toner image is transferred to the transfer material by producing a predetermined potential difference between an electric potential due to charge on the transfer material surface and an electric potential due to charge of the toner image on the image carrying body.

Thus, with the present invention, the adhesion of the transfer material to the transferring means and the transfer of the toner image are performed by inducing charges rather than injecting charges by atmospheric discharge of a conventional method. With this arrangement, a lower voltage is used, and the voltage is easily controlled. It is also possible to eliminate variations in the voltage due to environmental conditions. Furthermore, there is no need to separately provide a power source used for electrostatically adhering the transfer material to the surface of the dielectric layer, i.e., the surface of the transferring means and a power source used for transferring a toner image formed on the image carrying body to the transfer material, thereby achieving an inexpensive structure.

Moreover, by setting the volume resistivity of the dielectric layer to a value not lower than 40 percent of the volume resistivity of the semiconducting layer, the electric potential on the dielectric layer still increases after any portion of the transfer material passes through the contact section between the transferring means and the electrode member. Namely, by setting the volume resistivity of the dielectric layer to a value not lower than 40 percent of the volume resistivity of the semiconducting layer, a current component flowing in the circuit is made greater than a current component for causing the dielectric layer to function as a power source. In other words, in the transferring means, since the function as a capacitor is stronger than the function as the power source, charges accumulate on the dielectric layer.

Accordingly, the transfer material can stably electrostatically adhere to the transferring means without being separated from the transferring means until all the toner images in the respective colors are transferred from the image carrying body to the transfer material. It is thus possible to achieve a satisfactory transfer of toner from the image carrying body to the transferring material, providing a stable image.

A preferred volume resistivity of the dielectric layer is within a range of from $10^9 \Omega\cdot cm$ to $10^{15} \Omega\cdot cm$.

When the volume resistivity of the dielectric layer is within a range of from $10^9 \Omega\cdot cm$ to $10^{15} \Omega\cdot cm$, the transfer material can stably electrostatically adhere to the transferring means without being separated from the transferring means until all the toner images in the respective colors are transferred from the image carrying body to the transfer material.

If the volume resistivity of the dielectric layer is smaller than $10^9 \Omega\cdot cm$, the resistance is too small, and an excessive current flows in the section between the image carrying body and the transferring means during a transfer of toner. Therefore, a current component flowing due to the ohmic contact takes precedence over a current component flowing due to the movement of the toner from the image carrying body to the transfer material, preventing the movement of the toner to the transfer material. As a result, an unfavorable back transfer occurs.

On the other hand, if the volume resistivity of the dielectric layer is greater than $10^{15} \Omega\cdot cm$, the resistance is too large. Therefore, both of the current component flowing due to the ohmic contact and the current component flowing due to the movement of the toner from the image carrying body to the transfer material are reduced, preventing the movement of the toner to the transfer material. As a result, an unsatisfactory transfer occurs.

The volume resistivity of the semiconducting layer is preferably within a range of from $10^6 \Omega\cdot cm$ to $10^{11} \Omega\cdot cm$, and more preferably within a range of from $10^8 \Omega\cdot cm$ to $10^{11} \Omega\cdot cm$.

When the volume resistivity of the semiconducting layer is within the above-mentioned ranges, the transfer material can stably electrostatically adhere to the transferring means without being separated from the transferring means until all the toner images in the respective colors are transferred from the image carrying body to the transfer material.

If the volume resistivity of the semiconducting layer is smaller than $10^6 \Omega\cdot cm$, the resistance is too small, and an excessive current flows in the section between the image carrying body and the transferring means during a transfer of toner. Therefore, a current component flowing due to the ohmic contact takes precedence over a current component flowing due to the movement of the toner from the image carrying body to the transfer material, preventing the movement of the toner to the transfer material. Consequently, an unfavorable back transfer occurs.

On the other hand, if the volume resistivity of the semiconducting layer is greater than $10^{11} \Omega\cdot cm$, the resistance is too large. Therefore, both of the current component flowing due to the ohmic contact and the current component flowing due to the movement of the toner from the image carrying body to the transfer material are reduced, preventing the movement of the toner to the transfer material. As a result, an unsatisfactory transfer occurs.

In order to achieve the above object, it is desirable to adhere the dielectric layer, the semiconducting layer and the conducting layer to each other without producing cavities therebetween.

In this structure, the movement of charges from the conducting layer to the semiconducting layer can never be prevented by such a cavity. Moreover, since the semiconducting layer and the dielectric layer adhere to each other without producing cavities therebetween, the induction of charges from the semiconducting layer to the dielectric layer can never be prevented by such a cavity.

If cavities are present between the conducting layer and the semiconducting layer, the cavities may function as a resistor and prevent the movement of charges from the conducting layer to the semiconducting layer. Similarly, if cavities are present between the semiconducting layer and the dielectric layer, the cavities may function as a resistor and prevent the movement of charges from the semiconducting layer to the dielectric layer. Furthermore, since the volume and density of the cavities are not uniform, it is difficult to perform control. For this reason, it is desirable not to produce cavities between the dielectric layer and the semiconducting layer and between the semiconducting layer and the conducting layer.

Thus, by adhering the dielectric layer, the semiconducting layer and the conducting layer to each other without producing cavities therebetween, it is possible to stably adhere the transfer material to the transferring means in a stable manner. As a result, the transfer material can stably electrostatically adhere to the transferring means without being separated from the transferring means until all the toner images in the respective colors are transferred from the image carrying body to the transfer material. It is therefore possible to prevent unsatisfactory adhesion of the transfer material to the transferring means, achieving a satisfactory transfer of the image.

In order to achieve the above object, it is desirable to form the dielectric layer and the semiconducting layer as an integrally molded two-layer polymer film sheet.

In this structure, the number of layers to be adhered to the conducting layer is reduced to one layer. Namely, it is necessary to adhere only a layer of the integrally molded two-layer polymer film sheet to the conducting layer. The use of the integrally molded two-layer polymer film sheet allows film sheets as the dielectric layer and the semiconducting layer having different volume resistivities to adhere to each other without the presence of small cavities therebetween. On the other hand, when the dielectric layer and the semiconducting layer are formed as separate layers, small cavities are present therebetween. Since these small cavities produce considerable resistance, Paschen's discharge characteristic and the charge injection characteristic are lowered. Namely, when the dielectric layer and the semiconducting layer are formed as separate layers, even if the same voltage is applied, the charges induced on the transfer material are reduced compared to the case when the integrally molded two-layer polymer film sheet is used, weakening the electrostatic adhesion of the transfer material to the transferring means. Therefore, the use of the integrally molded two-layer polymer film sheets provides a more stable image.

Additionally, in order to achieve the above object, an image forming apparatus of the present invention includes:

an image carrying body (for example, a photoreceptor drum) on which a toner image is to be formed;

transferring means (for example, a transfer drum) for transferring a toner image formed on the image carrying body to a transfer material by bringing the transfer material into contact with the image carrying body, the transferring means having a dielectric layer made of, for example, polyvinylidene fluoride, a semiconducting layer made of, for example, urethane foam, and a conducting layer made of, for example, aluminum, laminated in this order from a contact side of the transfer material which comes into contact with the transfer material;

voltage applying means (for example, a power source section), connected to the conducting layer, for applying a predetermined voltage to the conducting layer; and potential difference generating means (for example, a conducting roller) which is grounded, disposed in an upstream section in the transporting direction of the transfer material with respect to a transfer position on the surface of the dielectric layer and comes into contact with the surface of the dielectric layer through the transfer material, wherein the voltage applying means applies a voltage ranging from 1000 V to 2500 V to the transferring means when the volume resistivity of the semiconducting layer is within a range of from $10^6$ Ω•cm to $10^{10}$ Ω•cm and the volume resistivity of the dielectric layer is within a range of from $10^9$ Ω•cm to $10^{13}$ Ω•cm.

In this structure, when the transfer material is paper, the transfer efficiency can be significantly improved. Namely, when the transfer material is paper, the transfer efficiency varies depending on the applied voltage. However, for example, when an OHP sheet of synthetic resin is used as the transfer material, the transfer efficiency does not substantially depend on the applied voltage irrespectively of the volume resistivities of the semiconducting layer and the dielectric layer.

Therefore, when the volume resistivity of the semiconducting layer is within a range of from $10^6$ Ω•cm to $10^{10}$ Ω•cm and the volume resistivity of the dielectric layer is within a range of from $10^9$ Ω•cm to $10^{13}$ Ω•cm, it is possible to perform an efficient transfer by applying a voltage ranging from 1000 V to 2500 V to the transferring means irrespectively of whether the transfer material is paper or an OHP sheet. Namely, when the transfer material is the OHP sheet, it is possible to decide the applied voltage so that an advantage is given in adhering paper to the transferring means. On the other hand, when the transfer material is paper, the transfer efficiency can further be improved.

It is desirable that the image forming apparatus further includes humidity detecting means for detecting the humidity around the transferring means, and is constructed so that the voltage applying means applies to the conducing layer a voltage according to the result of detection made by the humidity detecting means.

In this structure, a voltage according to the humidity can be applied to the conducting layer. More specifically, since the volume resistivities of the semiconducting layer, the dielectric layer and the transfer material vary depending on the humidity, even if the same voltage is applied, the transfer efficiency varies depending on the humidity at the time of transfer. Thus, an optimum transfer efficiency is achieved under various humidity conditions by detecting the humidity before adhering the transfer material to the transferring means and applying to the conducting layer a voltage according to the result of detection made by the humidity detecting means. In particular, when the transfer material is paper, since paper is likely to be affected by the humidity and the transfer efficiency depends on the applied voltage, it is possible to further improve the transfer efficiency by applying to the conducting layer a voltage according to the result of detection made by the humidity detecting means.

For a fuller understanding of the nature and advantages of the invention, reference should be made to the ensuing detailed description taken in conjunction with the accompanying drawings.

DESCRIPTION OF THE PREFERRED EMBODIMENTS

[EMBODIMENT 1]

The following description will discuss one embodiment of the present invention with reference to FIGS. 1 to 20.

Figure 1:
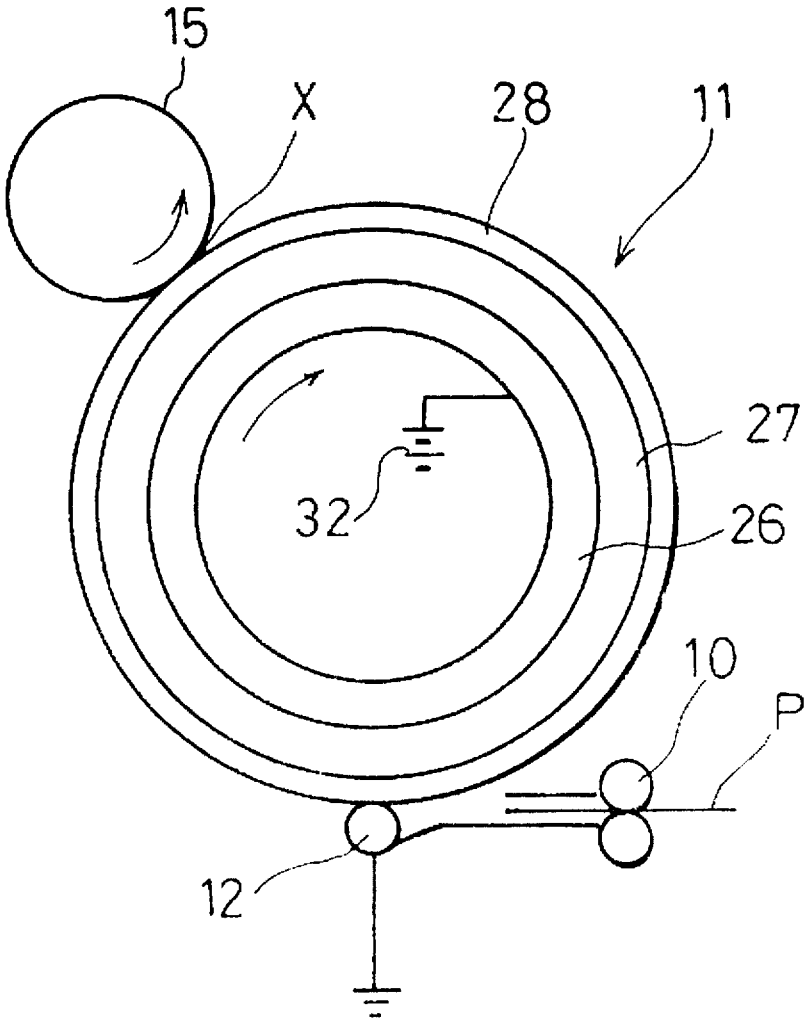
FIG. 1 schematically shows the structure near a transfer drum in an image forming apparatus according to Embodiment 1 of the present invention.
Figure 2:
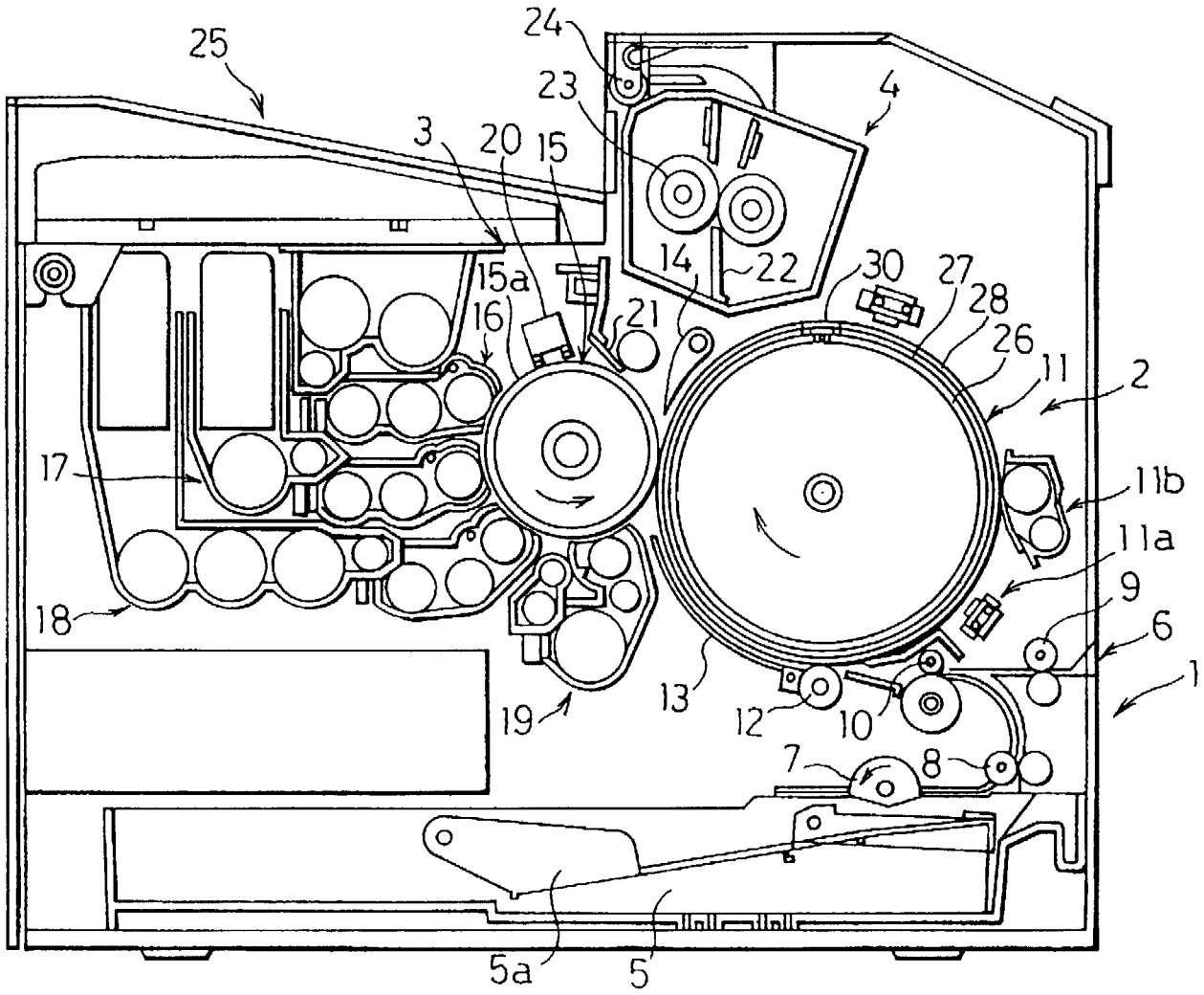
FIG. 2 schematically shows the structure of the image forming apparatus including the transfer drum of FIG. 1.

As illustrated in FIG. 2, an image forming apparatus of this embodiment includes a feeding section 1 for storing and supplying a transfer material P (see FIG. 1) as a recording material on which a toner image is formed, a transfer section 2 for transferring the toner image to the transfer material P, a development section 3 for forming the toner image, and a fixing section 4 for fixing the toner image transferred to the transfer material P by fusion.

The feeding section 1 includes a feed cassette 5, and a manual-feed section 6. The feed cassette 5 is detachably installed on the lowest level of the main body of the apparatus to store and supply the transfer material P to the transfer section 2. The manual-feed section 6 is located on the front side of the main body to manually supply the transfer material P sheet by sheet from the front. The feeding section 1 is equipped with a pickup roller 7, pre-feed rollers (PF rollers) 8, a manual-feed roller 9, and pre-curling rollers (PS rollers) 10 as pre-curling means. The pickup roller 7 feeds the transfer material P sheet by sheet from the topmost sheet in the feed cassette 5. The PF rollers 8 transport the transfer material P fed from the pickup roller 7. The manual-feed roller 9 transports the transfer material P from the manual-feed section 6. The PS rollers 10 curl the transfer material P transported by the PF rollers 8 or the manual-feed rollers 9 before the transfer section 2.

A feeding member 5*a* which is pushed upward by, for example, a spring, is mounted in the feed cassette 5 so that sheets of the transfer material P are laid down on the feeding member 5*a*. In this structure, the topmost sheet of the transfer material P in the feed cassette 5 comes into contact with the pickup roller 7, and the transfer material P is fed sheet by sheet with a rotation of the pickup roller 7 in the direction of an arrow and transported to the PS rollers 10.

Similarly, the transfer material P supplied from the manual-feeding section 6 is transported to the PS rollers 10 by the manual-feed rollers 9.

As described above, the PS rollers 10 curl the transported transfer material P so as to facilitate the adhesion of the transfer material P to the surface of a cylindrical transfer drum 11 in the transfer section 2.

The transfer section 2 includes the transfer drum 11 as transferring means. Disposed around the transfer drum 11 is a conducting roller 12 which is a grounded electrode member, functions as potential difference generating means and rotates with a rotation of the transfer drum 11, a guide member 13 for guiding the transfer material P so as to prevent the transfer material P from falling down from the transfer drum 11, and a separating claw 14 for coercively separating the transfer material P adhering to the transfer drum 11. The transfer drum 11 electrostatically attracts the transfer material P to the surface thereof. Therefore, a charge removing device 11*a* as charge removing means is disposed around the transfer drum 11. The charge removing device 11*a* performs a function on the transfer drum 11 after the separation of the transfer material P from the transfer drum 11, and removes the residual charges adhering the transfer drum 11, for example, at the time of the separation of the transfer material P. The charge removing device 11*a* is located on the upstream side of the conducting roller 12. Consequently, residual charges are not present on the transfer drum 11, and adhesion of the next transfer material P to the transfer drum 11 is achieved in a stable manner. Also provided around the transfer drum 11 is a cleaning device 11*b* as cleaning means. The cleaning device 11*b* is located on the upstream side of the charge removing device 11*a*, performs a function on the transfer drum 11 after the separation of the transfer material P from the transfer drum 11, and removes the residual toner adhering to the transfer drum 11. In this structure, the transfer drum 11 is cleaned before the next transfer material P adheres thereto, thereby achieving stable adhesion of the next transfer material P to the transfer drum 11. In this structure, the separating claw 14 is installed so that it is freely attached to or detached from the surface of the transfer drum 11. The detail of the structure of the transfer drum 11 will be given later.

The development section 3 includes a photoreceptor drum 15 as an image carrying body which is pressed against the transfer drum 11. The photoreceptor drum 15 is formed by a grounded conducting aluminum cylinder 15*a* coated with an OPC film 15*b* (see FIGS. 10 and 11).

Radially disposed around the photoreceptor drum 15 are developer devices 16, 17, 18 and 19 for storing yellow toner, magenta toner, cyan toner and black toner, respectively. Also disposed around the photoreceptor drum 15 are a charger 20 for charging the surface of the photoreceptor drum 15, and a cleaning blade 21 for scraping off and removing the residual toner on the surface of the photoreceptor drum 15. A toner image is formed on the photoreceptor drum 15 by each toner. Namely, with the photoreceptor drum 15, charging, exposure, development and transfer are performed with respect to one color, and such a sequence of operations are repeated for the respective colors.

Therefore, when performing a color transfer, a toner image in one color is transferred to the transfer material P which is electrostatically adhering to the transfer drum 11 with one rotation of the transfer drum 11, and one color image is formed by a maximum of four rotations of the transfer drum 11.

In this embodiment, considering the transfer efficiency and the image quality, the photoreceptor drum 15 and the transfer drum 11 are pressed against each other so that a pressure of 8 kg is applied to a transfer position.

The fixing section 4 includes fixing rollers 23 for fusing a toner image with predetermined heat and pressure to fix the toner image onto the transfer material P, and a fixing guide 22 for guiding the transfer material P which has been separated from the transfer drum 11 by the separating claw 14 to the fixing rollers 23 after a transfer of the toner image.

Disposed in a downstream section with respect to the fixing section 4 in the transporting direction of the transfer material P is an output roller 24 for outputting the transfer material P onto which the toner image has been fixed from the main body of the apparatus to an output tray 25.

Referring now to FIG. 1, the following description will discuss the structure of the transfer drum 11.

As illustrated in FIG. 1, the transfer drum 11 is formed by a conducting layer 26 made of a cylindrical aluminum as a base member, a semiconducting layer 27, and a dielectric layer 28. A power source 32 is connected to the conducting layer 26 so as to allow an application of a charging voltage or a charge removing voltage.

The semiconducting layer 27 is not particularly limited and, for example, formed by a semiconducting material such as urethane.

When forming the semiconducting layer 27 by urethane foam, it is possible to foam-molding urethane directly on the conducting layer 26.

For example, in a method for foam-molding urethane on the conducting layer 26, primary foaming is performed by pre-heating a bead-like starting material, and then the foamed material is left to stand, cured and dried for a predetermined time. Next, after putting the primary foam into a mold formed by the conducting layer 26, molding is carried out by reheating the mold to execute secondary foaming in which filling of spaces between particles and fusing are performed. Consequently, the semiconducting layer 27 made of urethane is fixed on the conducting layer 26. As a result, the cavity between the conducting layer 26 and the semiconducting layer 27 is eliminated, and the conducting layer 26 and the semiconducting layer 27 closely adhere to each other.

Thus, by foam-molding urethane directly on the conducting layer 26, the adhesion between the conducting layer 26 and the semiconducting layer 27 is improved. This method prevents a lowering of the electrostatic adhesion which is caused by cavities between the conducting layer 26 and the semiconducting layer 27 and between the semiconducting layer 27 and the dielectric layer 28 during the formation of the semiconducting layer 27 by winding a sheet of urethane foam around the dielectric layer 26. It is therefore possible to satisfactorily adhere the transfer material P to the transfer drum 11 and transfer the toner image during printing, including multiple printing.

A method for foam-molding the semiconducting layer 27 is not particularly limited to the one mentioned above. Namely, it is possible to foam-molding the semiconducting layer 27 by another method.

The dielectric layer 28 is formed on the semiconducting layer 27 after forming the semiconducting layer 27 on the conducting layer 26. The dielectric layer 28 is not particularly limited, and formed by a dielectric substance such as PVDF (polyvinylidene fluoride).

When forming the dielectric layer 28 from PVDF, it is possible to shape the PVDF into a cylindrical seamless thin film sheet and fix the film sheet to the semiconducting layer 27 by thermal shrinkage.

Figure 3:
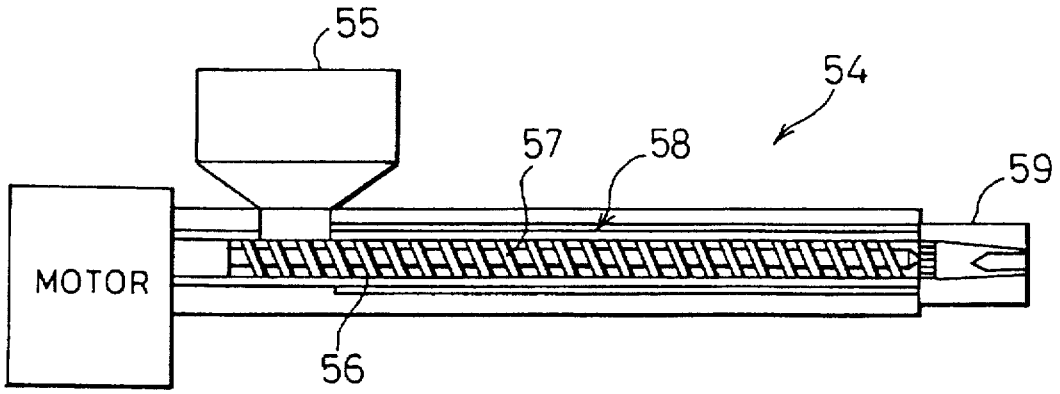
FIG. 3 schematically shows the structure of an extruding section of an extruder used in a process of manufacturing the transfer drum of FIG. 1.
Figure 4:
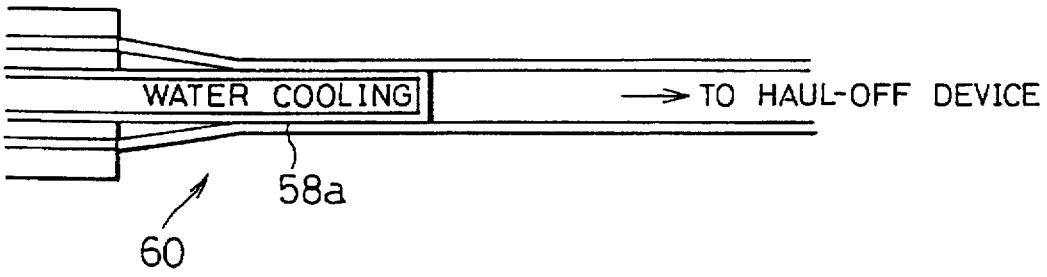
FIG. 4 schematically shows the structure of a sizing section of the extruder of FIG. 3.
Figure 5:
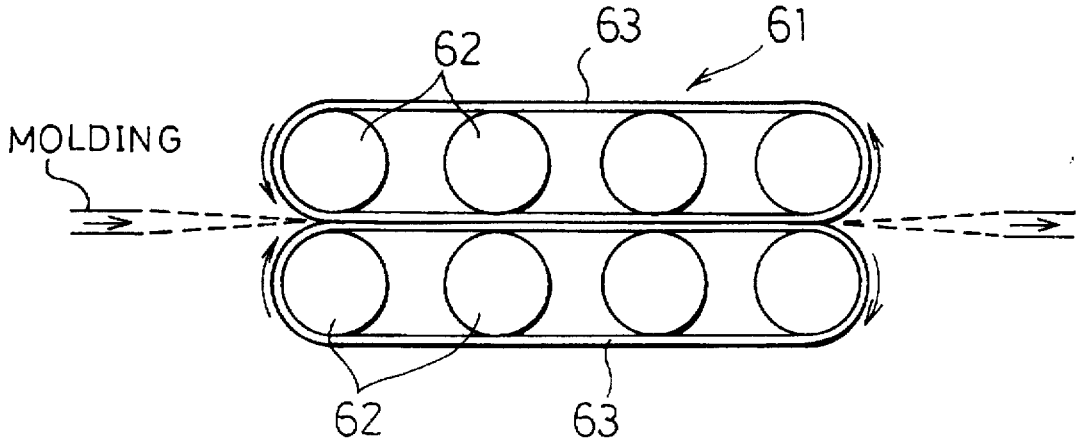
FIG. 5 schematically shows the structure of a haul-off device used in the process of manufacturing the transfer drum of FIG. 1.

Referring now to FIGS. 3 to 5, the following description will discuss a method for producing cylindrical seamless thin film sheet of PVDF. FIG. 3 shows an extruding section 54 of a typical extruder which heats and extrudes a molding material. The extruding section 54 includes a hopper 55 as a molding material feed opening, a cylinder 56 having a screw 57 for extruding the molding material into a die 59, to be described later, a heating and cooling unit 58 for heating and cooling the molding material, and the die 59 having a circular opening, disposed in a downstream side of the cylinder 56.

FIG. 4 shows a sizing section 60 which is disposed in an edge of the extruder to form a molding of predetermined shape and dimensions by cooling and setting the molding material extruded by the extruding section 54.

FIG. 5 shows a haul-off device 61 for pulling and winding or cutting the molding extruded from the sizing section 60 of the extruder. The haul-off device 61 is formed by a pair of rubber belts 63 having a plurality of nip rolls 62.

First, a pellet of PVDF is supplied from the hopper 55 to the cylinder 56. Next, the pellet of PVDF is heated to plasticize in the heating and cooling unit 58. Meanwhile, the screw 57 is retracted, i.e., unscrewed, while mixing the melted PVDF, and injects the PVDF remaining in an edge section of the screw 57 at a stretch.

The PVDF injected from the cylinder 56 is transported to the die 59. Thus, the shape and thickness of the molding is decided by the injection of the PVDF through the circular opening of the die 59.

Subsequently, the PVDF is transported to the sizing section 60, and water-cooled in a cooling section **58*a* of the heating and cooling unit 58 to regulate the shape and dimensions from the inside as shown in FIG. 4**.

As illustrated in FIG. 5, the PVDF pulled from the sizing section 60 is taken into a section between the rubber belts 63 of the haul-off device 61, and cut. A cylindrical seamless thin film sheet is thus formed by the above-mentioned method.

In one example of the method for fixing the cylindrical seamless thin film sheet of PVDF on the semiconducting layer 27, the cylindrical seamless thin film sheet of PVDF is fixed on the semiconducting layer 27 by thermal shrinkage. More specifically, the PVDF is hot-melt polar chain macromolecule and forms an anisotropy when heated, and its alignment is broken down by reheating. Then, the PVDF shrinks in making an attempt to return to an original state, and adheres and is fixed to the semiconducting layer 27.

Thermal shrinkage is grouped into two types, dry type and wet type. Thermal shrinkage of dry type is preferred because it is capable of reducing changes in the physical properties of PVDF, such as the resistance and the permittivity. More specifically, when the PVDF is used for the dielectric layer 28, it is possible to eliminate cavities between the semiconducting layer 27 and the dielectric layer 28 by adhering and fixing the dielectric layer 28 onto the semiconducting layer 27 by dry-type thermal shrinkage. As a result, the adhesion of the transfer material P to the transfer drum 11 and a transfer of the toner image can be performed in a stable manner.

Moreover, as described above, when using the urethane foam as the semiconducting layer 27 and the cylindrical seamless thin film sheet of PVDF as the dielectric layer 28, it is possible to perform foam-molding urethane and thermal shrinkage of the cylindrical seamless thin film sheet of PVDF at a time by heating the semiconducting layer 27 and the dielectric layer 28 at the same time. It is thus possible to eliminate cavities between the conducting layer 26 and the semiconducting layer 27 and between the semiconducting layer 27 and the dielectric layer 28, achieving improved adhesion between the conducting layer 26 and the semiconducting layer 27 and between the semiconducting layer 27 and the dielectric layer 28. Consequently, the adhesion of the transfer material P to the transfer drum 11 and the toner transfer performance can be improved even when performing multiple printing.

In an another method for adhering the semiconducting layer 27 and the dielectric layer 28, a conducting bonding agent is applied between the semiconducting layer 27 and the dielectric layer 28. This method also prevents cavities between the semiconducting layer 27 and the dielectric layer 28, and achieves improved adhesion therebetween. Consequently, even when performing multiple printing, enhanced adhesion of the transfer material P to the transfer drum 11 and improved toner transfer performance can be achieved.

It is possible to easily control the permittivity and resistance of the semiconducting layer 27 and the dielectric layer 28 obtained by this method to have predetermined values by suitably setting the content and/or the layer thickness of a filler or a conducting agent. As a result, desired characteristics including charging performance can be easily obtained.

A still another method for adhering the semiconducting layer 27 and the dielectric layer 28 uses an integrally molded two-layer polymer film sheet (integrally molded sheet). In this method, the semiconducting layer 27 and the dielectric layer 28 are formed as one thin film sheet. The following description will explain the method for forming the integrally molded two-layer polymer film sheet, and the method for fixing the integrally molded two-layer polymer film sheet to the conducting layer 26 by thermal shrinkage.

Figure 6:
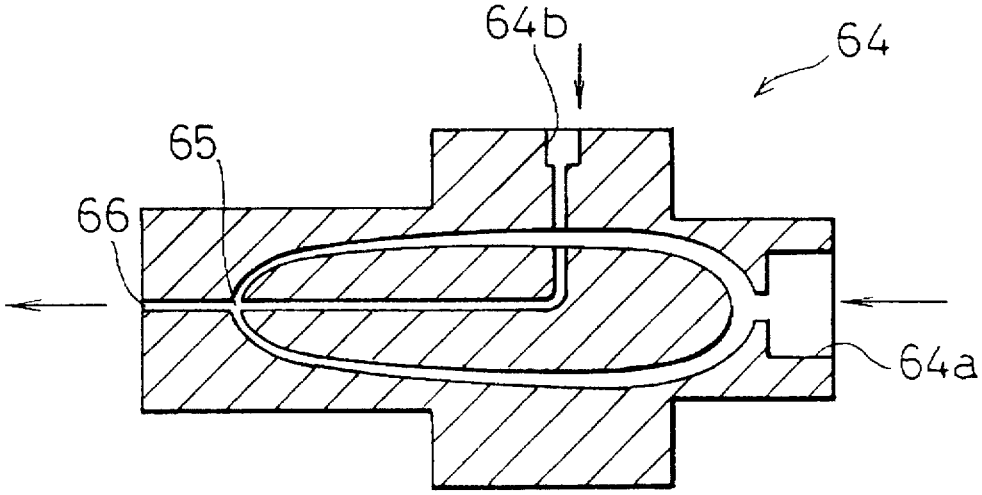
FIG. 6 shows a cross section of a mold used in another process of manufacturing the transfer drum of FIG. 1.

The integrally molded two-layer polymer film sheet is formed by a molding device 64 shown in FIG. 6. The molding device 64 has two-layer-die structure formed by a dielectric layer fabricating die **64*a* disposed on a side section of the molding device 64 and a semiconducting layer fabricating die 64*b* located in an upper section thereof. The dielectric layer fabricating die 64*a* and the semiconducting layer fabricating die 64*b* join at a junction 65**.

First, an outer layer forming resin for fabricating the dielectric layer 28 is injected into the dielectric layer fabricating die **64*a* by an extruder, not shown, and is transported to the junction 65. At this time, an inner surface coating resin for forming the semiconducting layer 27 is injected into the semiconducting layer fabricating die 64*b* through a screw extruder, not shown, and is transported to the junction 65 through a spiral die. Consequently, the resins join at the junction 65, and pushed out from a common extrusion opening 66** as a melted two-layer film, i.e., a melted integrally molded two-layer polymer film sheet.

The melted integrally molded two-layer polymer film sheet extruded in the above-mentioned manner is then cooled and set by so-called pneumatic sizing or wet vacuum sizing.

It is possible to easily control the permittivity and resistance of the integrally molded two-layer polymer film sheet to have predetermined values by suitably determining the content of a filler or a conducting agent and/or the layer thickness. This control allows the permittivity and the resistance of the dielectric layer 28 and the semiconducting layer 27 of the integrally molded two-layer polymer film sheet to have the same values as those of the dielectric layer 28 and the semiconducting layer 27 which are molded separately. It is therefore possible to obtain the same characteristics including the charging performance in both cases when the dielectric layer 28 and the semiconducting layer 27 are formed as the integrally molded two-layer polymer film sheet and when the dielectric layer 28 and the semiconducting layer 27 are separately formed.

The integrally molded two-layer film sheet obtained in the above-mentioned manner can be fixed on the conducting layer 26 by a fixing method using thermal shrinkage. Thus, with the use of the integrally molded two-layer polymer film sheet, it is possible to easily adhere the semiconducting layer 27 and the dielectric layer 28. As a result, the charging performance and the charge removing performance on the transfer drum 11 are further improved. Consequently, improved adhesion of the transfer material P to the transfer drum 11 and satisfactory toner transfer performance can be achieved.

Moreover, it is possible to reduce the number of layers to be adhered to the conducting layer 26 to one layer by using the integrally molded two-layer polymer film sheet as dielectric layer 28 and the semiconducting layer 27. Thus, the method of using the integrally molded two-layer polymer film sheet can provide transferring means having a simplified structure compared to the method in which the dielectric layer 28 and the semiconducting layer 27 are separately adhered.

Furthermore, the use of the integrally molded two-layer polymer film sheet allows film sheets whose volume resistivity differs from each other, i.e., the dielectric layer 28 and the semiconducting layer 27, to adhere to each other without the presence of small cavities therebetween. On the other hand, when the dielectric layer 28 and the semiconducting layer 27 are formed as separate layers, small cavities are present therebetween. Since these small cavities produce considerable resistance, Paschen's discharge characteristic and the charge injection characteristic are lowered. Namely, when the dielectric layer 28 and the semiconducting layer 27 are formed as separate layers, even if the same voltage is applied, the charges induced on the transfer material P are reduced compared to the case when the integrally molded two-layer polymer film sheet is used, causing a lowering of the electrostatic adhesion of the transfer material P to the transfer drum 11.

Thus, electrostatic adhesion of the transfer material P to the transfer drum 11 can be achieved in a more stable manner by using the integrally molded two-layer polymer film sheet as the dielectric layer 28 and the semiconducting layer 27. Consequently, the toner image can be transferred satisfactorily from the photoreceptor drum 15 to the transfer drum 11, thereby providing a more stable image.

Figure 7:
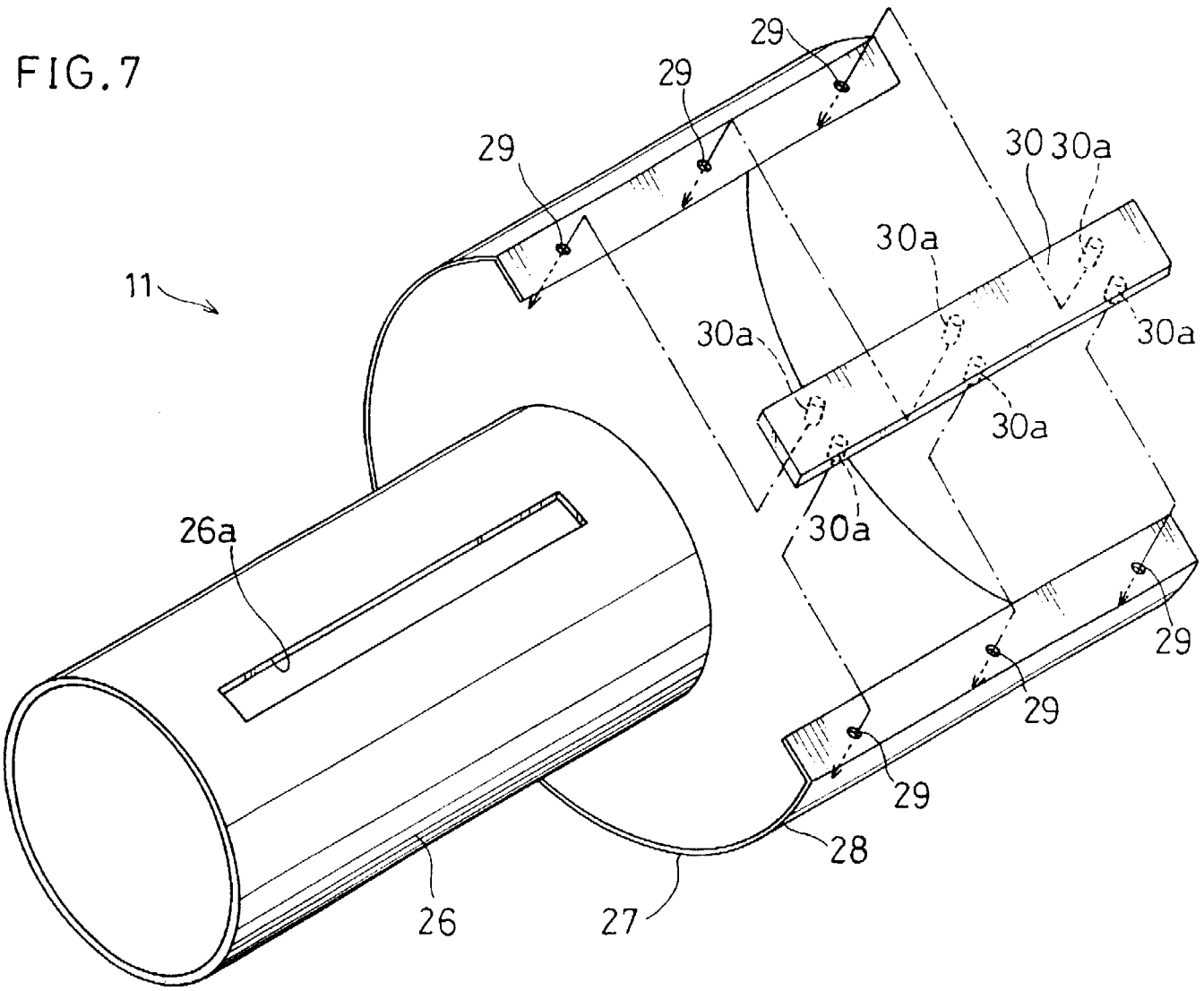
FIG. 7 is an explanatory view showing an example of a coupling state of a conducting layer, a semiconducting layer and a dielectric layer of the transfer drum of FIG. 1.

In another example of the method for fixing the conducting layer 26, the semiconducting layer 27 and the dielectric layer 28, as illustrated in FIG. 7, bosses **30*a* on the sheet holding plate 30 are arranged to fit into a plurality of holes 29 formed on both edges of the sheets of the semiconducting layer 27 and the dielectric layer 28. Subsequently, the bosses 30***a* are arranged to fit into an opening 26*a* formed on the upper surface of the conducting layer 26 so as to fix the semiconducting layer 27 and the dielectric layer 28 to the conducting layer 26.

In this fixing method, the semiconducting layer 27 and the dielectric layer 28 apply tension to the inner side of the conducting layer 26 using the sheet holding plate 30. It is therefore possible to prevent the respective layers from being raised or loosen.

In this case, since the respective layers are merely fixed by the sheet holding plate 30, replacement can be easily performed.

Figure 8:
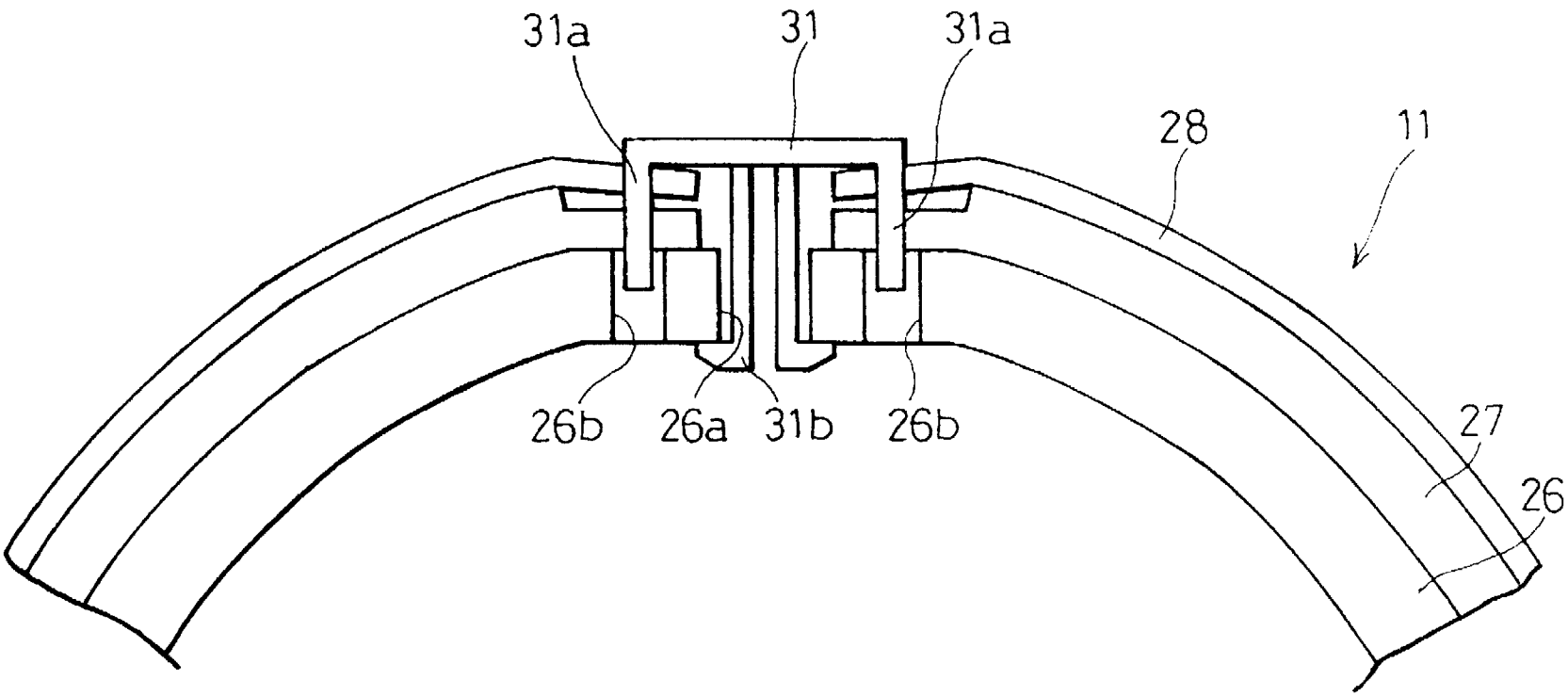
FIG. 8 is an explanatory view showing another example of a coupling state of the conducting layer, the semiconducting layer and dielectric layer of the transfer drum of FIG. 1.

As illustrated in FIG. 8, there is another method for fixing the sheets of the semiconducting layer 27 and the dielectric layer 28 to the conducting layer 26 by a sheet holding member 31 having bosses 31*a* on both edges and a fixing member 31*b* at the center thereof.

In this fixing method, the bosses 31*a* on the sheet holding member 31 are arranged to fit into the holes 29 formed on both edges of an opening 26*a* of the conducting layer 26, and a fixing member 31*b* of the sheet holding member 31 is inserted into the opening 26*a* so as to fix the sheets of the semiconducting layer 27 and the dielectric layer 28 to the conducting layer 26. The layers fixed in such a method can be easily replaced.

The conducting layer 26 is not limited to cylindrical aluminum, and may be formed by other conducting material. The semiconductor layer 27 is not limited to urethane foam, and may be formed by other elastic materials such as silicones. The dielectric layer 28 is not limited to PVDF, and may be formed by other dielectric material, for example resins such as polyethylene terephthalate.

As described above, the fabrication method and the fixing method of the conducting layer 26, the semiconducting layer 27 and the dielectric layer 28 are not particularly limited. However, a method for fixing the respective layers by heating with the use urethane foam as the semiconducting layer 27 and a cylindrical seamless thin film sheet of PVDF as the dielectric layer 28 is preferred because foam-molding of urethane and thermal shrinkage of the cylindrical seamless thin film sheet of PVDF are simultaneously performed, and improved adhesion is achieved between the conducting layer 26 and the semiconducting layer 27 and between the semiconducting layer 27 and the dielectric layer 28.

Moreover, by performing foam-molding of urethane and thermal shrinkage of the cylindrical seamless thin film sheet of PVDF at the same time, the number of fabrication processes is decreased and the fabrication cost is reduced compared to the method including fabricating the semiconducting layer 27 and the dielectric layer 28 separately, and fixing these layers separately.

The method using the integrally molded two-layer polymer film sheet as the dielectric layer 28 and the semiconducting layer 27 is preferred because this method allows the film sheets whose volume resistivity differs from each other, i.e., the dielectric layer 28 and the semiconducting layer 27, to adhere to each other without the presence of small cavities, and achieves more stable electrostatic adhesion of the transfer material P to the transfer drum 11.

In addition, when the integrally molded two-layer polymer film sheet is used as the dielectric layer 28 and the semiconducting layer 27, the number of layers to be adhered to the conducting layer 26 is reduced to only one layer. It is thus possible to simplify the structure of the transfer drum 11 compared to a method for adhering the dielectric layer 28 and the semiconducting layer 27 separately.

Figure 9:
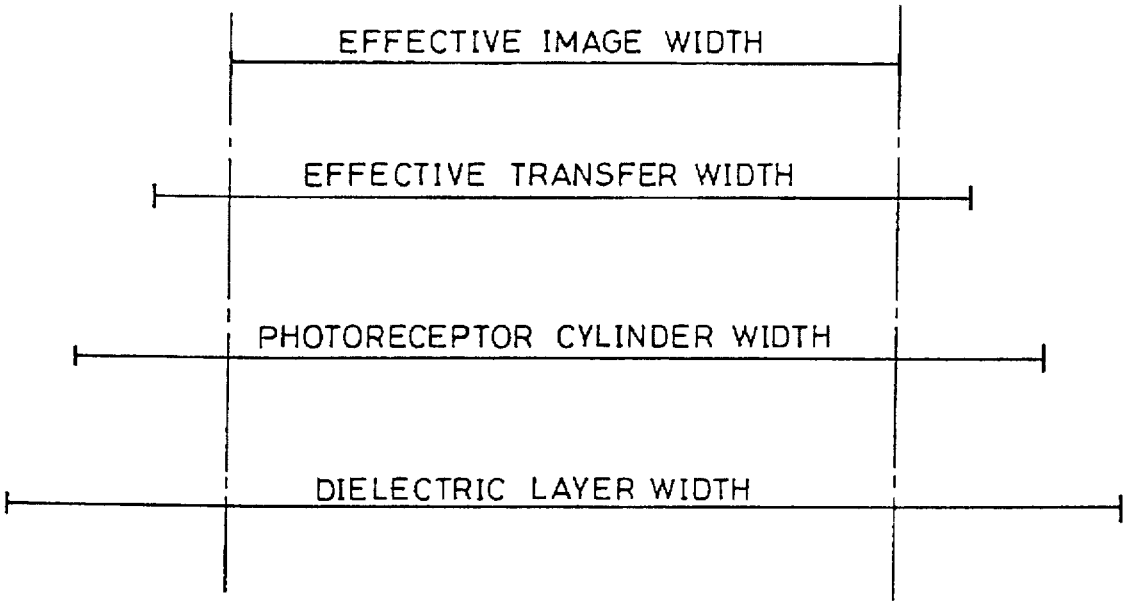
FIG. 9 is an explanatory view showing a comparison between a charged width of the transfer drum of FIG. 1 and an effective image width.

As illustrated in FIG. 9, the width of the dielectric layer 28 of the transfer drum 11 is greater than the width of a photoreceptor cylinder (aluminum cylinder 15*a*) forming the photoreceptor drum 15, the width of the photoreceptor cylinder is greater than an effective transfer width, and the effective transfer width is greater than an effective image width (the width of an OPC film 15*b* applied).

Figure 10:
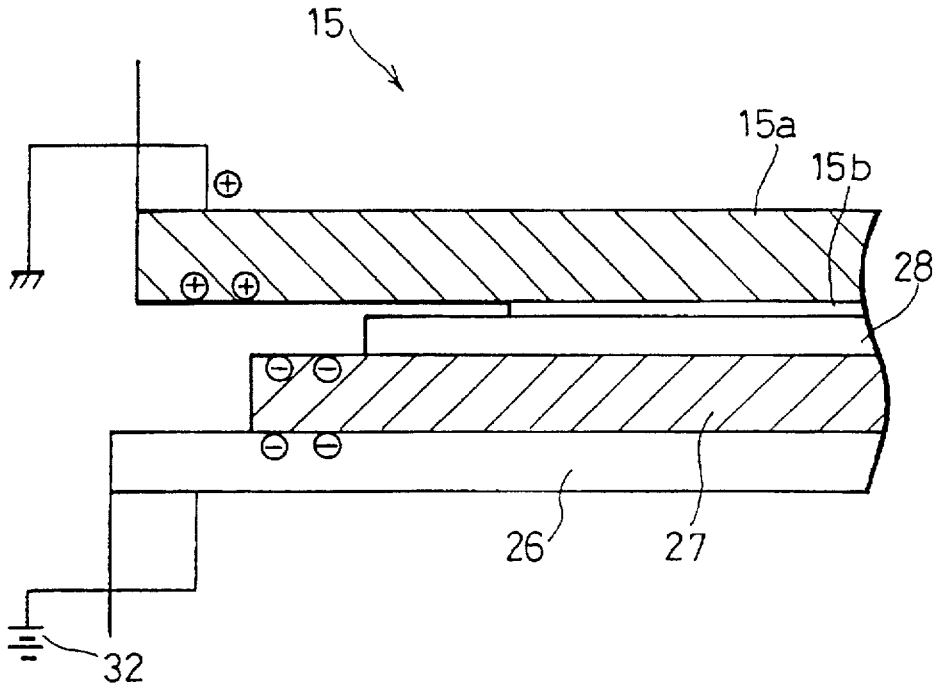
FIG. 10 is an explanatory view showing the movement of charges between the transfer drum of FIG. 1 and a photoreceptor drum when the widths of the respective layers of the transfer drum satisfy the relation, dielectric layer<semiconducting layer<conducting layer.

Moreover, as shown in FIG. 10, if the width of the respective layers of the transfer drum 11 establishes such a relation that the conducting layer 26>the semiconducting layer 27>the dielectric layer 28, the semiconducting layer 27 may come into contact with the grounded aluminum cylinder 15*a* of the photoreceptor drum 15.

More specifically, when a positive voltage is applied to the conducting layer 26 by the power source 32, negative charges are induced on a side of the conducting layer 26 facing the dielectric layer 28. At this time, if the grounded aluminum cylinder 15*a* of the photoreceptor drum 15 comes into contact with the semiconducting layer 27, all the charges on the semiconducting layer 27 move to the aluminum cylinder 15*a*. This prevents the transfer drum 11 from attracting toner which has negative charges and is adhering to the OPC film 15*b*, resulting in an unsatisfactory transfer.

Figure 11:
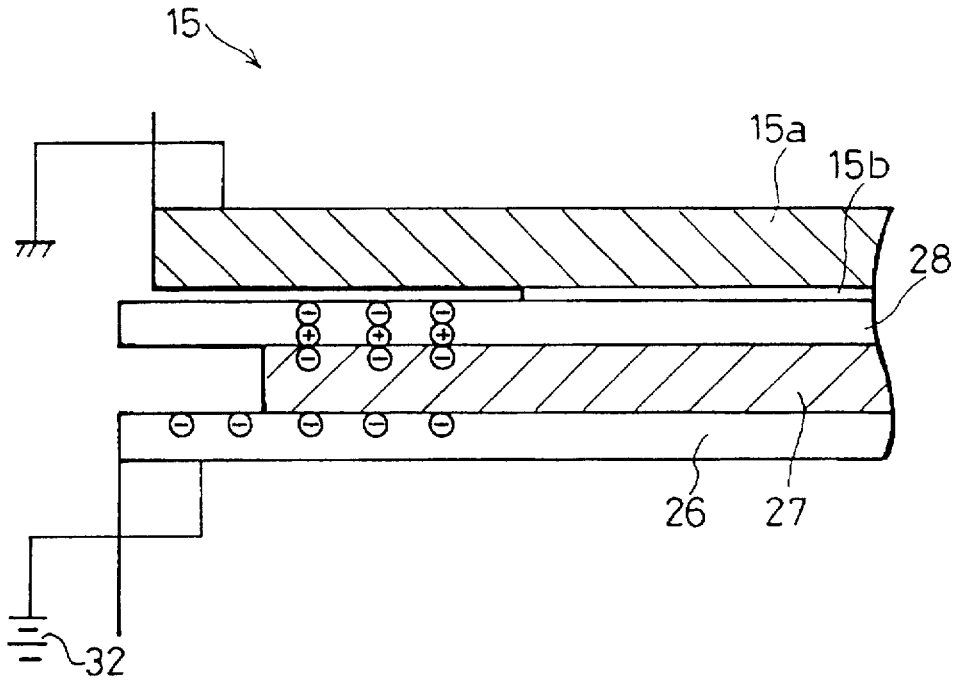
FIG. 11 is an explanatory view showing the movement of charges between the transfer drum of FIG. 1 and the photoreceptor drum when the widths of the respective layers of the transfer drum satisfy the relation, semiconducting layer<dielectric layer=conducting layer.

In order to solve such a problem, as illustrated in FIG. 11, the conducting layer 26 and the dielectric layer 28 of the transfer drum 11 are arranged to have an equal width, and the width of the semiconducting layer 27 is arranged to be smaller than the width of the conducting layer 26 and the dielectric layer 28. This arrangement prevents the grounded aluminum cylinder 15*a* from coming into contact with the semiconducting layer 27 and a leakage of charge.

Consequently, the transfer drum 11 can attract the toner having negative charges adhering to the OPC film 15*b*, thereby preventing an unsatisfactory transfer.

The diameter of the transfer drum 11 is set so that a sheet of the transfer material P is wound around the transfer drum 11 without overlapping, i.e., according to the maximum width or length of the transfer material P for use in the image forming apparatus of the present invention.

As a result, the transfer material P can be wound around the transfer drum 11 in a stable manner, thereby improving the transfer efficiency and the image quality.

Figure 12:
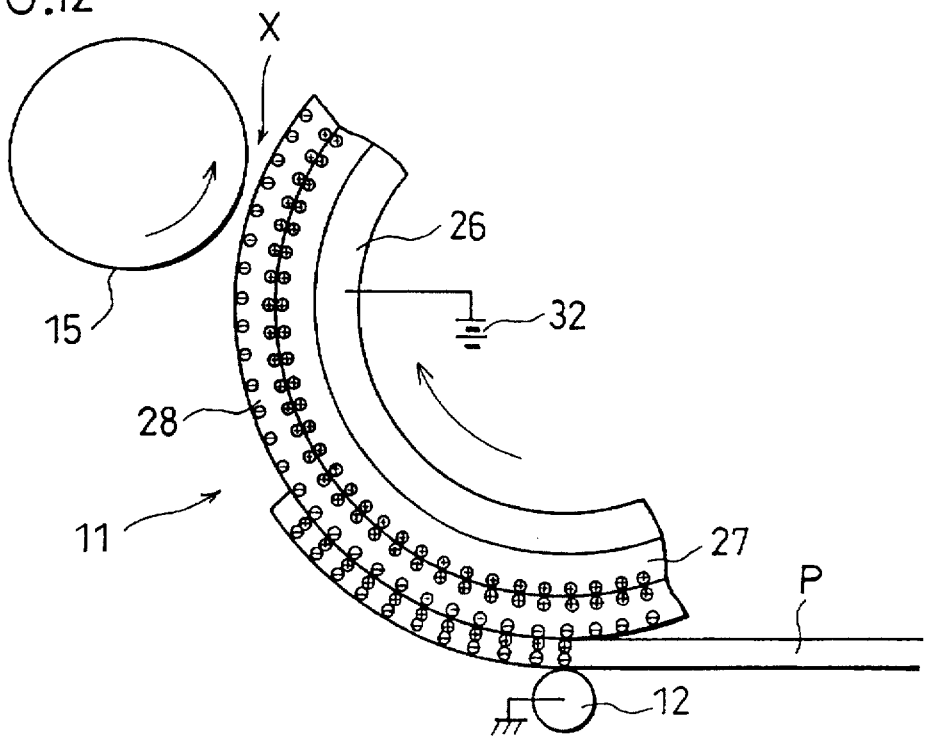
FIG. 12 is an explanatory view showing a charged state of the transfer drum of FIG. 1 in an initial state in which a transfer material has been transported to the transfer drum.
Figure 13:
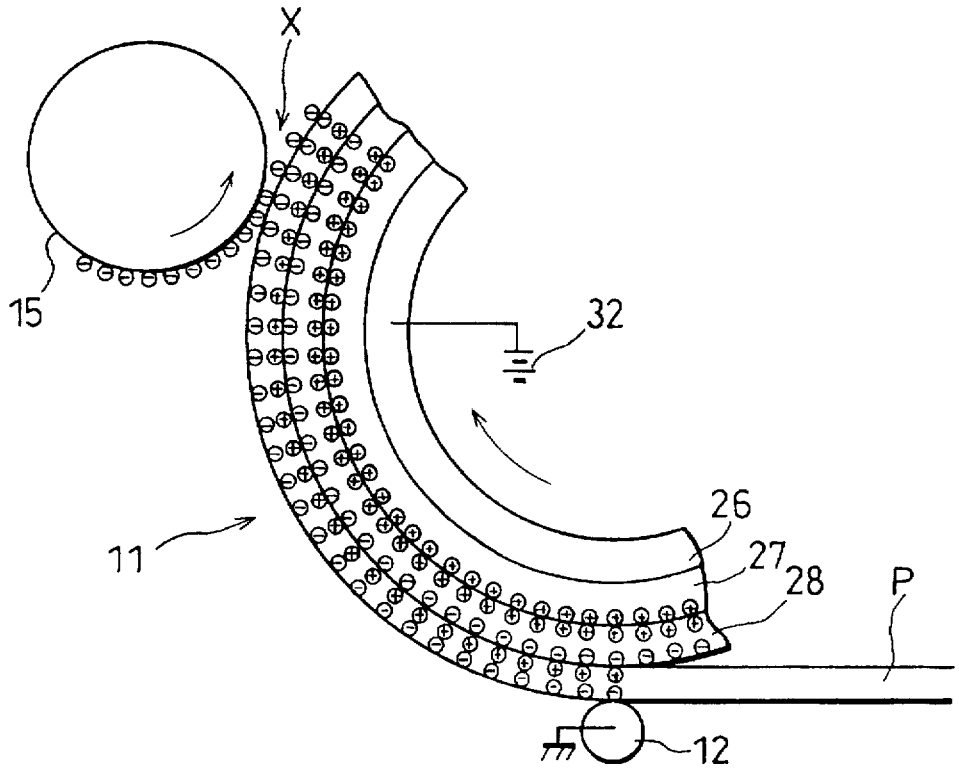
FIG. 13 is an explanatory view showing a charged state of the transfer drum of FIG. 1 in a state in which the transfer material has been transported to a transfer position of the transfer drum.

Referring now to FIGS. 12 and 13, the following description will discuss the adhesion of the transfer material P to the transfer drum 11 and the transfer operation. It is assumed that a positive voltage is applied to the conducting layer 26 of the transfer drum 11 by the power source 32.

First, adhesion of the transfer material P to the transfer drum 11 will be discussed. As illustrated in FIG. 12, when the transfer material P transported to the transfer drum 11 is pressed against the surface of the dielectric layer 28 by the conducting roller 12, negative charges are induced on the surface of the dielectric layer 28. As a result, an electric field is generated from the transfer drum 11 to the conducting roller 12. The surface of the transfer drum 11 is uniformly charged with the rotation of the conducting roller 12 and the transfer drum 11. As the electric field strength applied to a contact section between the dielectric layer 28 and the conducting roller 12, i.e., a nip, increases, an atmospheric dielectric breakdown occurs, causing a discharge from the transfer drum 11 to the conducting roller 12, i.e., Paschen's discharge.

After the discharge, charges are injected from the conducting roller 12 to the transfer drum 11 in the nip between the conducting roller 12 and the transfer drum 11, and negative charges further accumulate on the surface of the transfer drum 11. Namely, the positive charges accumulate on an inner side of the transfer material P, i.e., on a side in contact with the dielectric layer 28, due to Paschen's discharge and the charge injection caused by Paschen's discharge. Consequently, the transfer material P electrostatically adheres to the transfer drum 11. The force of adhesion is not varied when the voltage applied to the conducting layer 26 is constant. It is therefore possible to achieve stable adhesion of the transfer material P to the transfer drum 11.

As described above, since the conducting layer 26 is not charged by atmospheric discharge but is charged by contact, it is possible to apply a lower voltage to the conducting layer 26. It was found from the results of various experiments that a suitable voltage to be applied to the conducting layer 26 is not higher than +3 kV. More preferably, if the applied voltage is +2 kV, the conducting layer 26 is satisfactorily charged.

With a rotation of the transfer drum 11 in the direction of an arrow, the transfer material P adhering to the transfer drum 11 is transported to a position (transfer position X) where a toner image is transferred to the transfer material P having a positively charged outer surface.

Next, the transfer process of the transfer material P is explained below. As illustrated in FIG. 13, toner having negative charges on a surface thereof adheres to the photoreceptor drum 15. When the transfer material P having negative charges on a surface thereof is transported to the transfer position X, the toner adheres to the surface of the transfer material P due to the potential difference between the charge produced by a positive voltage applied to the conducting layer 26 and the negative charge of the toner. As a result, the negative charge of toner is attracted, and transferred to the negatively charged transfer material P due to an electric field formed by the negatively charged toner on the photoreceptor drum 15 and a positive voltage applied to the transfer drum 11.

The transfer drum 11 and the photoreceptor drum 15 are pressed against each other so as to produce a predetermined nip width at the transfer position X. Namely, the transfer efficiency, i.e., the image quality is affected by the nip width. The relationship between the nip width and the image quality is shown in Table 1.

TABLE 1

| Nip Width | 1 | 2 | 3 | 4 | 5 | 6 | 7 | 8 | 9 | 10 |
|---|---|---|---|---|---|---|---|---|---|---|
| Image Quality | x | Δ | o | o | o | o | Δ | x | x | x |
| | unsatisfactory transfer ←——→ printing blots, etc. | | | | | | | | | |
| | | | | | | | | | | Unit: mm |

o: excellent, Δ: fair, x: unsatisfactory

As shown in Table 1, satisfactory image quality is obtained by setting the nip width within a range between 2 mm and 7 mm, and more preferably within a range between 3 mm and 6 mm.

The semiconducting layer 27 has a volume resistivity of $10^8$ Ω•cm, a thickness of 2 mm to 5 mm, a hardness of 25 to 50 in the unit of Askar C. These values are set in relation with the transfer drum 11 and the photoreceptor drum 15 which are brought into contact with each other by a pressure of 8 kg in this embodiment.

Namely, if the material of the semiconducting layer 27 is changed, the pressure for bringing the transfer drum 11 and the photoreceptor drum 15 into contact with each other varies. In order to achieve desired image quality, the thickness and hardness of the semiconducting layer 27 are varied depending on the material.

In this embodiment, therefore, the nip width is set within an appropriate range by using the semiconducting layer 27 having the above-mentioned thickness and hardness.

The Asker C indicates the hardness of a sample measured by a hardness measuring device produced according to the standard of Japanese Rubber Association. Specifically, the hardness measuring device indicates the hardness of a sample by pressing a ball-point needle designed for hardness measurement against a surface of the sample using a force of a spring and measuring the depth of indentation produced by the needle when the resistive force of the sample and the force of spring balance. With the standard of Askar C, when the depth of indentation produced by the needle with the application of load of 55 g to the spring becomes equal to the maximum displacement of the needle, the hardness of the sample is indicated as zero degree. Also, when the depth of indentation produced by the application of load of 855 g is zero, the hardness of the sample is indicated as one hundred degrees.

If the volume resistivity of the semiconducting layer 27 is 0 Ω•cm, the voltage is lowered before the transfer material P reaches the transfer position X through the conducting roller 12 disposed at the adhesion start position of the transfer material P. Namely, if the volume resistivity of the semiconducting layer 27 is 0 Ω•cm, since the conducting roller 12 is grounded, a large amount of charge moves from the conducting layer 26 to the conducting roller 12, causing a lowering of the voltage. The lowering of the voltage decreases the power of attracting the transfer material P. In order to prevent the lowering of the voltage, the semiconducting layer 27 is arranged to have a predetermined volume resistivity and to function as a capacitor.

The relationship between the volume resistivity of the semiconducting layer 27 and the image quality is shown in Table 2.

TABLE 2

| Volume resistivity | $10^3$ | $10^4$ | $10^5$ | $10^6$ | $10^7$ | $10^8$ | $10^9$ | $10^{10}$ | $10^{11}$ | $10^{12}$ | $10^{13}$ | $10^{14}$ |
|---|---|---|---|---|---|---|---|---|---|---|---|---|
| Image quality | x | x | x | Δ | Δ | Δ | o | o | Δ | x | x | x |
| | back transfer ←——→ unsatisfactory transfer | | | | | | | | | | | |
| | | | | | | | | | | | | unit: Ω · cm |

o: excellent, Δ: fair, x: unsatisfactory

As shown in Table 2, an excellent transfer is achieved without a back transfer nor an unsatisfactory transfer when the volume resistivity of the semiconducting layer 27 is within a range between $10^6$ Ω•cm and $10^{11}$ Ω•cm. The volume resistivity of the semiconducting layer 27 is preferably within a range between $10^8$ Ω•cm and $10^{11}$ Ω•cm, and more preferably within a range between $10^9$ Ω•cm and $10^{10}$ Ω•cm.

If the volume resistivity of the semiconducting layer 27 is smaller than $10^6$ Ω•cm, the resistance is too small, and an excessive current flows in the section between the photoreceptor drum 15 and the transfer drum 11 during a transfer of toner. Therefore, a current component flowing due to the ohmic contact takes precedence over a current component flowing due to the movement of the toner from the photoreceptor drum 15 to the transfer material P, preventing the movement of the toner to the transfer material P. As a result, an unsatisfactory transfer occurs.

On the other hand, if the volume resistivity of the semiconducting layer 27 is greater than $10^{11}$ Ω•cm, the resistance is too large. Therefore, both of the current component flowing due to the ohmic contact and the current component flowing due to the movement of the toner from the photoreceptor drum 15 to the transfer material P are reduced, preventing the movement of the toner to the transfer material P. Namely, an unfavorable back transfer occurs.

Moreover, when the volume resistivity of the dielectric layer 28 is 0 Ω•cm, a lowering of the voltage occurs before the transfer material P reaches the transfer position X due to the conducting roller 12 located at the start position for attracting the transfer material P. Namely, when the volume resistivity of the dielectric layer 28 is 0 Ω•cm, since the conducting roller 12 is grounded, a large amount of charge moves from the semiconducting layer 27 to the conducting roller 12, causing a lowering of the voltage. The lowering of the voltage causes a lowering of the power for attracting the transfer material P. Therefore, by arranging the dielectric layer 28 to have a predetermined volume resistivity and to function as a capacitor, a lowering of the voltage is prevented.

The relationship between the volume resistivity of the dielectric layer 28 and the image quality is shown in Table 3.

TABLE 3

| Volume resistivity | $10^8$ | $10^9$ | $10^{10}$ | $10^{11}$ | $10^{12}$ | $10^{13}$ | $10^{14}$ | $10^{15}$ | $10^{16}$ |
|---|---|---|---|---|---|---|---|---|---|
| Image quality | x | Δ | Δ | ○ | ○ | ○ | Δ | Δ | x |
| | | back transfer ←——→ unsatisfactory transfer | | | | | | | |
| | | | | | | | | | unit: Ω · cm |

○: excellent, Δ: fair, x: unsatisfactory

As is clear from the results shown in Table 3 that if the volume resistivity of the dielectric layer 28 is smaller than $10^9$ Ω•cm, the resistance is too small, and an excessive current flows in the section between the photoreceptor drum 15 and the transfer drum 11 during a transfer of toner. Therefore, a current component flowing due to the ohmic contact takes precedence over a current component flowing due to the movement of the toner from the photoreceptor drum 15 to the transfer material P, preventing the movement of the toner to the transfer material P. As a result, an unfavorable back transfer occurs. On the other hand, if the volume resistivity of the dielectric layer 28 is greater than $10^{15}$ Ω•cm, the resistance is too large. Therefore, both of the current component flowing due to the ohmic contact and the current component flowing due to the movement of the toner from the photoreceptor drum 15 to the transfer material P are reduced, preventing the movement of the toner to the transfer material P. As a result, an unsatisfactory transfer occurs. A favorable result is obtained when the volume resistivity of the dielectric layer 28 is within a range of from $10^{11}$ Ω•cm to $10^{13}$ Ω•cm.

Figure 14:
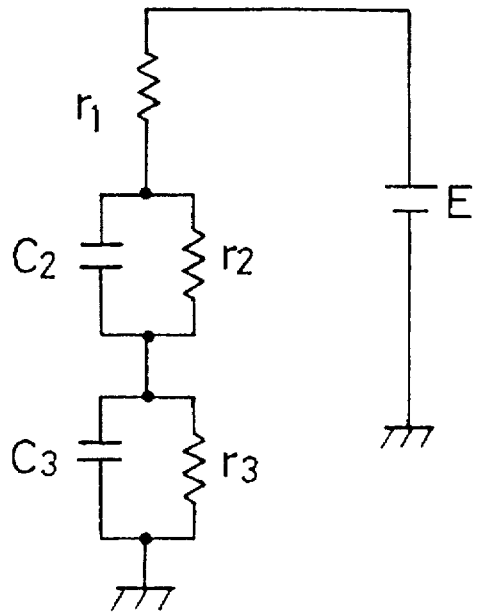
FIG. 14 shows an equivalent circuit of a charge injection mechanism between the transfer drum of FIG. 1 and a conducting roller.

The following description will explain the relation among the volume resistivity of the semiconducting layer 27, the volume resistivity of the dielectric layer 28, and the amount of charges accumulated on the dielectric layer 28, i.e., the electric potential on the dielectric layer 28, using an equivalent circuit shown in FIG. 14.

FIG. 14 illustrates a charge injection mechanism related to Paschen's discharge. The charge injections is equivalent to the accumulation of charges on a capacitor due to a current flowing through the circuit. More specifically, in FIG. 14, "E" represents a voltage applied to the conducting layer 26 from the power source 32, "r1" represents the volume resistivity of the semiconducting layer 27, "r2" represents the volume resistivity of the dielectric layer 28, "r3" represents the volume resistivity of the nip between the conducting roller 12 and the transfer drum 11, "C2" represents the electrostatic capacity of the dielectric layer 28, and "C3" represents the electrostatic capacity of the nip between the conducting roller 12 and the transfer drum 11.

In order to calculate the amount of charge accumulated on the dielectric layer 28, the equivalent circuit is analyzed based on a potential difference applied to the dielectric layer 28 by assuming the amount of charges (electric potential) produced by Paschen's discharge as an initial electric potential, and an electric potential is calculated by considering both of Paschen's discharge and the charge injection. Here, it is assumed that the charge injection occurs within a nip width (3 mm) between the conducting roller 12 and the transfer drum 11, and the time taken by a given portion of the transfer material P to pass through the nip width is 0.033 seconds.

A final electric potential V2 of the dielectric layer 28 is given by the analytical equation $$V2=\left(\frac{E}{r1r3c2c3}\right)\left(\frac{1}{N}\right)\left(\frac{2\left(1-e^{\left(-\frac{(L-N)t}{2}\right)}\right)}{L-N}-\frac{2\left(1-e^{\left(-\frac{(L+N)t}{2}\right)}\right)}{L+N}\right)+\left(\frac{1}{N}\right)(q+Lp)\left(e^{\left(-\frac{(L-N)t}{2}\right)}-e^{\left(-\frac{(L+N)t}{2}\right)}\right)+$$

$$p\left(\frac{\cos\left[\left(\sqrt{\frac{-L^2}{4}+M}\right)t\right]}{E^{\frac{Lt}{2}}}-\frac{L\sin\left[\left(\sqrt{\frac{-L^2}{4}+M}\right)t\right]}{2\left(\sqrt{\frac{-L^2}{4}+M}\right)E^{\frac{Lt}{2}}}\right)$$

where t is the charge injection time, L, M and N are constants depending on the circuit, p is the initial electric potential produced by Paschen's discharge, and q is the initial electric potential of the dielectric layer 28.

By setting the volume resistivity of the dielectric layer 28, i.e., r2, to (a) $2.5\times10^9$ Ω•cm, (b) $9.4\times10^{10}$ Ω•cm and (c)

Figure 15:
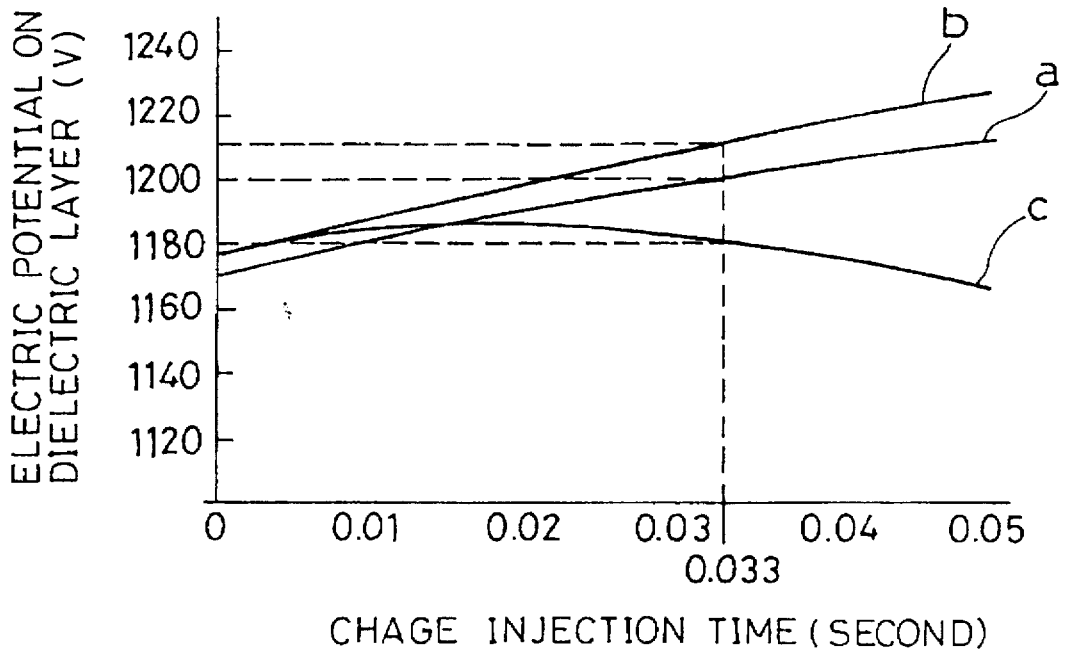
FIG. 15 is a graph showing a theoretical curve of electric potential generated by charge injection on the dielectric layer of the transfer drum 1.

$3.9\times10^8$ Ω•cm, and the volume resistivity of the semiconducting layer 27, i.e., r1, to $10^9$ Ω•cm, the above-mentioned analytical values are made into a graph. The results are shown in FIG. 15. The electric potential on the dielectric layer 28 in the nip time (0.033 seconds) during which a predetermined portion of the transfer material P passes through the nip is the final electric potential V2 caused by charges induced on the dielectric layer 28 by Paschen's discharge and the charge injection.

As a result, it was found that, when the volume resistivity of the dielectric layer 28 is (a) or (b), the electric potential on the dielectric layer 28 increases with time. However, when the volume resistivity of the dielectric layer 28 is (c), the electric potential on the dielectric layer 28 reaches a peak at the time the charge injection time is 0.01 to 0.02 seconds, and then decreases.

Namely, in the dielectric layer 28 with the volume resistivity (a) or (b), a current component flowing in the circuit is greater than a current component for causing the dielectric layer 28 to function as a power source. In other words, since the function as a capacitor is stronger than the function as the power source, charges accumulate with time.

On the other hand, when the volume resistivity is (c), since the volume resistivity of the dielectric layer 28 is much lower than that of the semiconducting layer 27, a current component for causing the dielectric layer 28 to function as a power source is greater than a current component flowing in the circuit. In other words, the function of the dielectric layer 28 as the power source is stronger than the function as a capacitor. Therefore, the charges which have moved from the semiconducting layer 27 accumulate on the dielectric layer 28 in a moment, and start to decrease before any portion of the transfer material P passes through the nip width.

Here, the transfer material P was inserted into the section between the conducting roller 12 and the transfer drum 11 having the semiconducting roller 27 with a volume resistivity of $10^9$ Ω•cm and the dielectric layer 28 with the volume resistivity (a), (b) or (c), and the electrostatic adhesion was evaluated. The electrostatic adhesion was evaluated by observing whether the transfer material P electrostatically adheres to the transfer drum 11 in a stable manner during four rotations of the transfer drum 11. The results are shown in Table 4.

TABLE 4

| | | | |
|---|---|---|---|
| Volume resistivity of dielectric layer (Ω · m) | $9.4\times10^{11}$ | $2.5\times10^{10}$ | $3.9\times10^{9}$ |
| Electrostatic adhesion | o | o | x |

o: transfer material is electrostatically adhering to transfer drum during four rotations of transfer drum
x: transfer material separates from transfer drum during four rotations of transfer drum It was found from the results shown in Table 4 that the transfer material P adheres to the transfer drum 11 in a stable manner when the dielectric layer 28 with the volume resistivity (a) or (b) is used, and that the transfer material P separates from the transfer drum 11 during four rotations of the transfer drum 11 when the dielectric layer with the volume resistivity (c) is used. Namely, as is clear from the results shown in FIG. 15 that, when the dielectric layer with the volume resistivity (c) is used, since the charge holding power of the dielectric layer 28 decreases during the four rotations of the transfer drum 11, the electrostatic adhesion of the transfer material P to the transfer drum 11 lowers, thereby separating the transfer material P from the transfer drum 11.

Moreover, with the use of the semiconducting layer 27 having a different volume resistivity, the electrostatic adhesion was evaluated in the same manner as above. As a result, the same results are obtained. If the transfer material P does not electrostatically adhere to the transfer drum 11 in a stable manner, the transfer process cannot be satisfactorily performed.

Furthermore, with the use of various dielectric layers 28 having different volume resistivities and various semiconducting layers 27 having different volume resistivities, an increase or a decrease in the electric potential generated on the transfer material P was examined. The results are shown in Table 5.

TABLE 5

| (volume resistivity of dielectric layer/volume resistivity of semi-conducting layer) × 100 | less than 40% | not less than 40% but less than 50% | not less than 50% but less than 60% | not less than 60% |
|---|---|---|---|---|
| Electric potential on transfer material | x | o | o | o |

o: increase in electric potential
x: decrease in electric potential

It was found from the results shown in Table 5 that when the volume resistivity of the dielectric layer 28 is less than 40 percent of the volume resistivity of the semiconducting layer 27, the charge injection is not performed in the time during which the given portion of the transfer material P passes through the nip width, i.e., during the nip time, and a decreased electric potential is generated on the transfer material P. Thus, when the volume resistivity of the dielectric layer 28 is less than 40 percent of the volume resistivity of the semiconducting layer 27, the electrostatic adhesion of the transfer material P to the dielectric layer 28 cannot be performed in a stable manner. On the other hand, it was found that, when the volume resistivity of the dielectric layer 28 is not less than 40 percent of the volume resistivity of the semiconducting layer 27, the charge injection is performed by Paschen's discharge, and the charge (electric potential) on the transfer material P becomes greater than the initial value of Paschen's discharge. Thus, by setting the volume resistivity of the dielectric layer 28 to a value not lower than 40 percent of the volume resistivity of the semiconducting layer 27, the transfer material P electrostatically adheres to the dielectric layer 28 in a stable manner.

Namely, by setting the volume resistivity of the dielectric layer 28 to a value not lower than 40 percent of the volume resistivity of the semiconducting layer 27, a current component flowing in the circuit is made greater than a current component for causing the dielectric layer 28 to function as a power source. In other words, since the function as a capacitor is stronger than the function as the power source, the charges accumulate on the dielectric layer 28. As a result, the electric potential on the dielectric layer 28 still increases after any portion of the transfer material P passes through the nip width. It is thus possible to achieve and keep uniform surface potential on the transfer drum 11 in a stable manner. This prevents unsatisfactory adhesion of the transfer material P to the transfer drum 11, and unsatisfactory transfer of the toner image to the transfer material P, thereby providing an excellent image.

Consequently, when the volume resistivity of the dielectric layer 28 is greater than 40 percent of the volume resistivity of the semiconducting layer 27 and the volume resistivity of the dielectric layer 28 is within a range of from $10^9$ Ω•cm to $10^{15}$ Ω•cm, and/or when the volume resistivity of the semiconducting layer 27 is within a range of from $10^6$ Ω•cm to $10^{11}$ Ω•cm, it is possible to achieve and keep uniform surface potential on the transfer drum 11 in a stable manner. Moreover, by using the integrally molded two-layer polymer film sheet as the dielectric layer 28 and the semiconducting layer 27, the film sheets of different volume resistivities as the dielectric layer 28 and the semiconducting layer 27 adhere to each other without the presence of small cavities therebetween. It is thus possible to electrostatically attract the transfer material P to the transfer drum 11 in a more stable manner, providing an image with improved quality.

Figure 16:
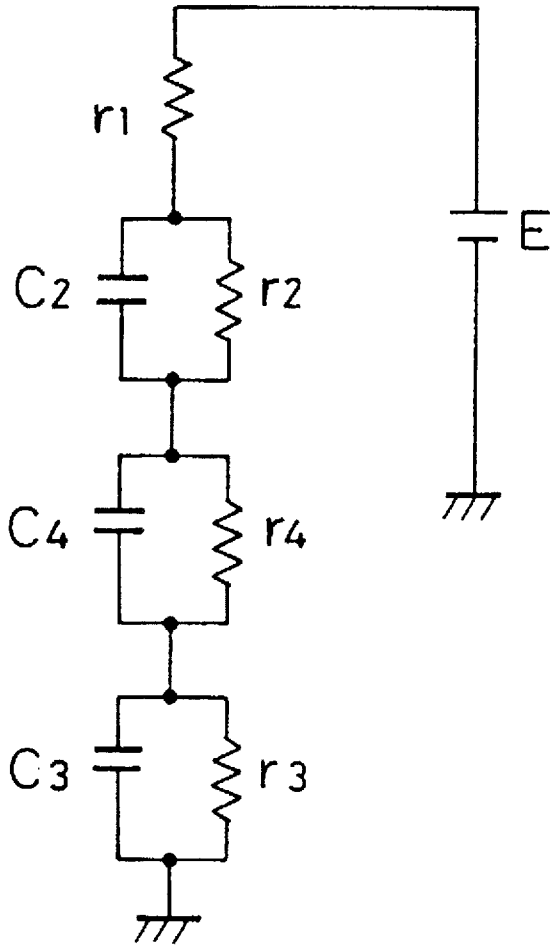
FIG. 16 shows an equivalent circuit of a charge injection mechanism between the conducting roller and a transfer drum having cavities between the dielectric layer and the semiconducting layer.

On the other hand, when providing the dielectric layer 28 and the semiconducting layer 27 as separate layers, a small cavity is present therebetween, and a significant resistance is added due to the small cavity. More specifically, as shown in FIG. 16, assuming that a capacitor component of the small cavity is C4 and a resistor component is r4, a parallel circuit of the capacitor component C4 and the resistor component r4 is added to the added to the equivalent circuit of FIG. 14. Consequently, Paschen's discharge characteristic and the charge injection characteristic are weakened. Therefore, even if the same voltage is applied, the amount of charges induced on the transfer material P when the dielectric layer 28 and the semiconducting layer 27 are provided as two separate layers is smaller than the amount of charge induced when the integrally molded two-layer polymer film sheet is used. Namely, enhanced electrostatic adhesion is achieved by using the integrally molded two layer polymer film sheet as the dielectric layer 28 and the semiconducting layer 27 compared to the case where two separate layers are used as the dielectric layer 28 and the semiconducting layer 27. Thus, with the use of the integrally molded two-layer polymer film sheet as the dielectric layer 28 and the semiconducting layer 27, the transfer material P can adhere to the transfer drum 11 in a more stable manner.

Referring now to FIGS. 2, 12 and 13, the following description will discuss an image forming process in the image forming apparatus having the above-mentioned structure.

First, as illustrated in FIG. 2, when automatically feeding the transfer material P, the transfer material P is fed sheet by sheet to the PF rollers 8 from the feed cassette 5 disposed on the lowest level of the main body. In this case, as shown in FIG. 12, the transfer material P is successively fed from the topmost sheet by the pickup roller 7. The transfer material P which has passed through the PF rollers 8 is curled along a surface shape of the transfer drum 11 by PS rollers 10.

On the other hand, when manually feeding the transfer material P, the transfer material P is fed sheet by sheet to the PS rollers 10 from the manual feeding section 6 located on the front side of the main body by the manual-feed rollers 9. Then, the transfer material P is curled along the surface shape of the transfer drum 11 by the PS rollers 10.

Second, as illustrated in FIG. 12, the transfer material P which has been curled by the PS rollers 10 is transported to the section between the transfer drum 11 and the conducting roller 12, and charges are induced on an outer surface of the transfer material P by a movement of the charges accumulated on the semiconducting layer 27 of the transfer drum 11 through the outer surface of the semiconducting layer 27 and an inner surface of the transfer material P. As a result, the transfer material P electrostatically adheres to the surface of the transfer drum 11.

Next, as illustrated in FIG. 13, the transfer material P adhering to the transfer drum 11 is transported to the transfer position X where the transfer drum 11 and the photoreceptor drum 15 are brought into contact with each other by pressure. Then, the toner image is transferred to the transfer material P due to the potential difference between the charge of the toner adhering to the photoreceptor drum 15 and the charge on the surface of the semiconducting layer 27 or conducting layer 26.

At this time, on the transfer drum 15, a series of charging, exposure, development and transfer operations are performed for each color. The transfer material P adhering to the transfer drum 11 is moved in a circular course by a rotation of the transfer drum 11. A one-color image is transferred with one rotation of the transfer drum 11, and a full-color image is obtained with the maximum of four rotations. Namely, when producing a black-and-white image or a mono-color image, it is necessary to rotate the transfer drum 11 only once.

Moreover, when all of the toner images have been transferred to the transfer material P, the transfer material P is forced to separate from the surface of the transfer drum 11 by the separating claw 14 which is movable to touch or separate from the circumference of the transfer drum 11, and is guided to the fixing guide 22.

The transfer material P is then guided to the fixing rollers 23 by the fixing guide 22, and the toner image on the transfer material P is fused and fixed onto the transfer material P by the heat and pressure of the fixing rollers 23.

The transfer material P carrying the image fixed thereon is discharged onto the output tray 25 by the discharge roller 24.

As described above, the transfer drum 11 includes the conducting layer 26, the semiconducting layer 27 and the dielectric layer 28 made of aluminum, urethane foam and PVDF, respectively, from inside toward outside. With this configuration, when a voltage is applied to the conducting layer 26, charges are successively induced on the conducting layer 26 and the semiconducting layer 27, and accumulate on the semiconducting layer 27. When the transfer material P is transported to the section between the transfer drum 11 and the conducting roller 12, the accumulated charges on the semiconducting layer 27 move to the transfer material P. As a result, the transfer material P electrostatically adheres to the transfer drum 11.

Hence, with the present invention, the adhesion of the transfer material P and the transfer of the toner are carried out by the induced charges rather than the injected charges by the conventional atmospheric discharge. It is therefore possible to decrease the applied voltage to the conducting layer 26, and easily control the voltage. Additionally, this method prevents a variation in the voltage due to environmental conditions.

Since the voltage applied to the transfer drum 11 is kept uniform without being influenced by environmental conditions such as humidity and temperature, the transfer efficiency and the image quality are improved.

In comparison with the conventional method in which the surface of the transfer drum 11 is charged by inducing charges through discharge, the surface of the transfer drum 11 is charged in a more stable manner. It is thus possible to stably perform the adhesion of the transfer material P to the transfer drum 11 and the transfer of the toner.

In addition, by simply applying the voltage to the conducting layer 26, charges are induced successively on the semiconductor layer 27 and the dielectric layer 28 in this order, and the surface of the transfer drum 11 is charged. It is thus possible to decrease the voltage, easily control the voltage, and reduce the driving energy.

Moreover, unlike the conventional structure, there is no need to use a plurality of chargers to apply the voltage because the voltage needs to be applied to only one region. It is therefore possible to simplify the apparatus and to reduce the manufacturing cost.

Furthermore, unlike the conventional atmospheric discharge, since the transfer drum 11 is charged by contact charging, the electric field does not change even if the surface of the transfer drum 11 is scratched. Namely, the balance of the electric field is kept even at the scratched section on the surface of the transfer drum 11, thereby improving the transfer efficiency.

Additionally, since this method is less influenced by environmental conditions such as the humidity and temperature of the air compared with the method using atmospheric discharge, it is possible to eliminate variations in the surface potential of the transfer drum 11, thereby preventing unsatisfactory adhesion of the transfer material P and a disorderly image. Consequently, the transfer efficiency and the image quality are improved.

Moreover, by setting the volume resistivity of the dielectric layer 28 to a value not lower than 40 percent of the volume resistivity of the semiconducting layer 27, a current component flowing in the circuit becomes greater than a current component for causing the dielectric layer 28 to function as a power source. It is thus possible to achieve and keep uniform surface potential on the transfer drum 11 in a stable manner. This prevents unsatisfactory adhesion of the transfer material P to the transfer drum 11, and unsatisfactory transfer of the toner image to the transfer material P, thereby providing an excellent image.

Furthermore, when the volume resistivity of the dielectric layer 28 is within a range of from $10^9$ Ω•cm to $10^{15}$ Ω•cm, and/or when the volume resistivity of the semiconducting layer 27 is within a range of from $10^8$ Ω•cm to $10^{11}$ Ω•cm, it is possible to achieve an efficient transfer without causing a so-called back transfer and an unsatisfactory transfer.

Consequently, when the volume resistivity of the dielectric layer 28 is set greater than 40 percent of the volume resistivity of the semiconducting layer 27 and the volume resistivity of the dielectric layer 28 is within a range of from $10^9$ Ω•cm to $10^{15}$ Ω•cm, and/or when the volume resistivity of the semiconducting layer 27 is within a range of from $10^8$ Ω•cm to $10^{11}$ Ω•cm, it is possible to achieve and keep uniform surface potential on the transfer drum 11 in a stable manner and provide an image with improved quality.

Additionally, since the dielectric layer 28, the semiconducting layer 27 and the conducting layer 26 adhere to each other without the presence of cavities therebetween, the movement of charges from the conducting layer 26 to the semiconducting layer 27, and the induction of charges from the semiconducting layer 27 to the dielectric layer 28 can never be prevented by such cavities. Thus, by adhering the dielectric layer 28, the semiconducting layer 27 and the conducting layer 26 without producing cavities, the transfer material P can stably electrostatically adhere to the transfer drum 11 without being separated from the transfer drum 11 until all the toner images in the respective colors are transferred from the photoreceptor drum 15 to the transfer material P. It is thus possible to achieve a satisfactorily transfer of toner from the photoreceptor drum 15 to the transfer drum 11, providing a stable image.

In addition, with the use of the integrally molded two-layer polymer film sheet as the dielectric layer 28 and the semiconducting layer 27, the number of layers to be adhered to the conducting layer 26 is reduced to one. It is thus possible to form the transferring means having a simplified structure compared to the method in which the dielectric layer 28 and the semiconducting layer 27 individually adhere to the conducting layer 26. Moreover, if the integrally molded two-layer polymer film sheet is used, the film sheets having different volume resistivities as the dielectric layer and the semiconducting layer adhere to each other without the presence of small cavities therebetween. It is therefore possible to perform an excellent transfer of toner from the photoreceptor drum 15 to the transfer drum 11, and provide an image in a more stable manner.

In this embodiment, an image forming apparatus having the PS rollers 10 is used. However, the present invention is not necessarily limited to such an image forming apparatus. The same effect as the use of the PS rollers 10 can be produced with an image forming apparatus having no PS rollers 10 depending on the types of transfer materials P.

Figure 17:
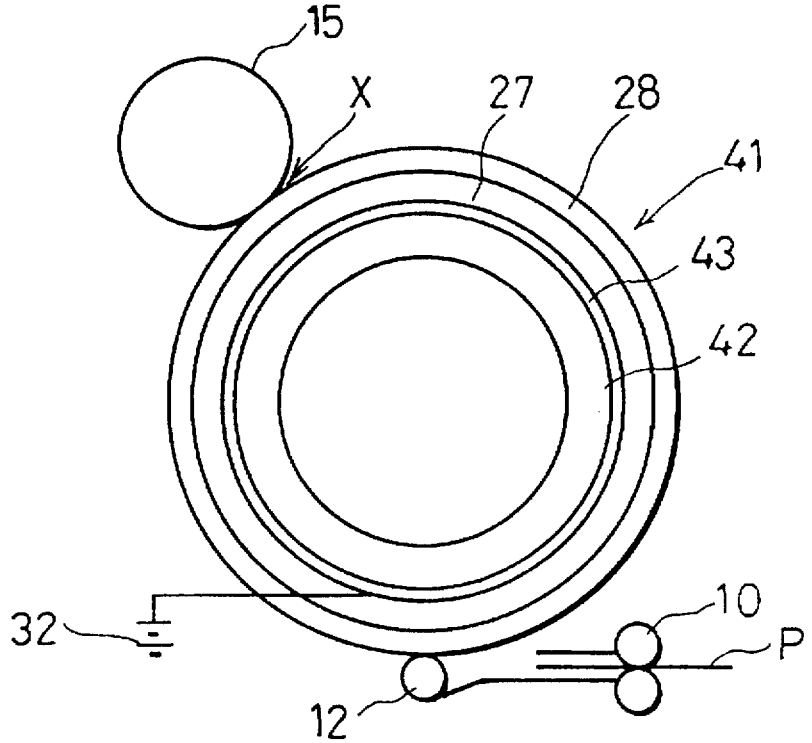
FIG. 17 is an explanatory view showing alternative structure of the transfer drum of FIG. 1.
Figure 18:
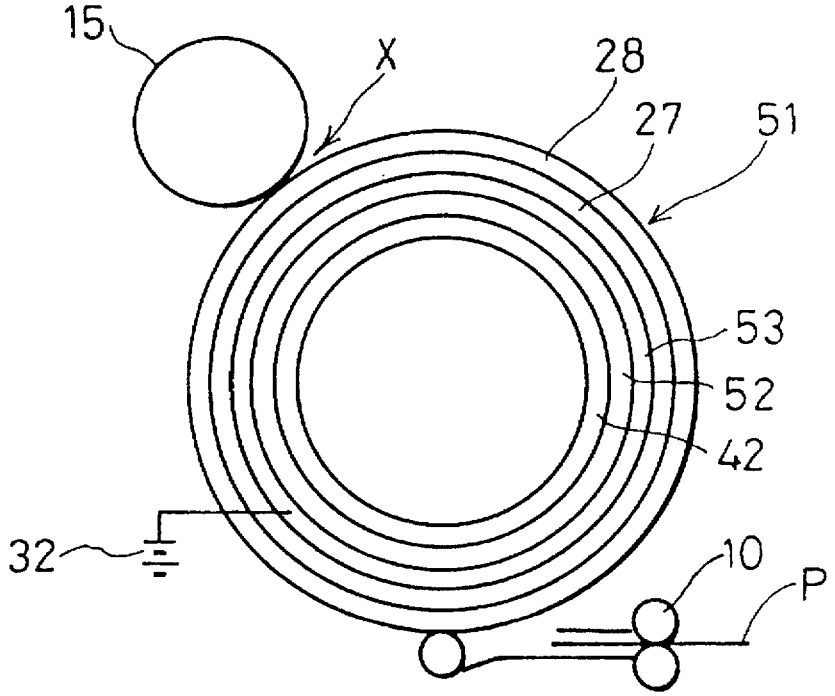
FIG. 18 is an explanatory view showing another alternative structure of the transfer drum of FIG. 1.

Moreover, with the use of a transfer drum 41 shown in FIG. 17 or a transfer drum 51 shown in FIG. 18 instead of the transfer drum 11, the similar effect can be obtained.

For instance, as shown in FIG. 17, a transfer drum 41 having the semiconducting layer 27 and the dielectric layer 28 may be used instead of the transfer drum 11. The transfer drum 41 includes a cylindrical base member (base layer) 42 made of a resin having a conducting thin film layer 43 such as copper foil and aluminum foil on a surface thereof, instead of the conducting layer 26 of the transfer drum 11, and the semiconducting layer 27 and the dielectric layer 28 formed in this order on the outer surface of the thin film layer 43.

Similarly to the transfer drum 11, by connecting the power source section 32 to the thin film layer 43 and applying a voltage, charges are stably induced on the surface of the dielectric layer 28, and adhesion of the transfer material P to the transfer drum 41 and a transfer of the toner image can be performed in a stable manner.

As described above, by forming the base member 42 which is located inside of the transfer drum 41 from a resin and placing a conducting body such as thin copper foil on the surface thereof, the manufacturing cost is reduced compared to the use of the conducting layer 26 of the transfer drum 11 as the conducting body.

Figure 19:
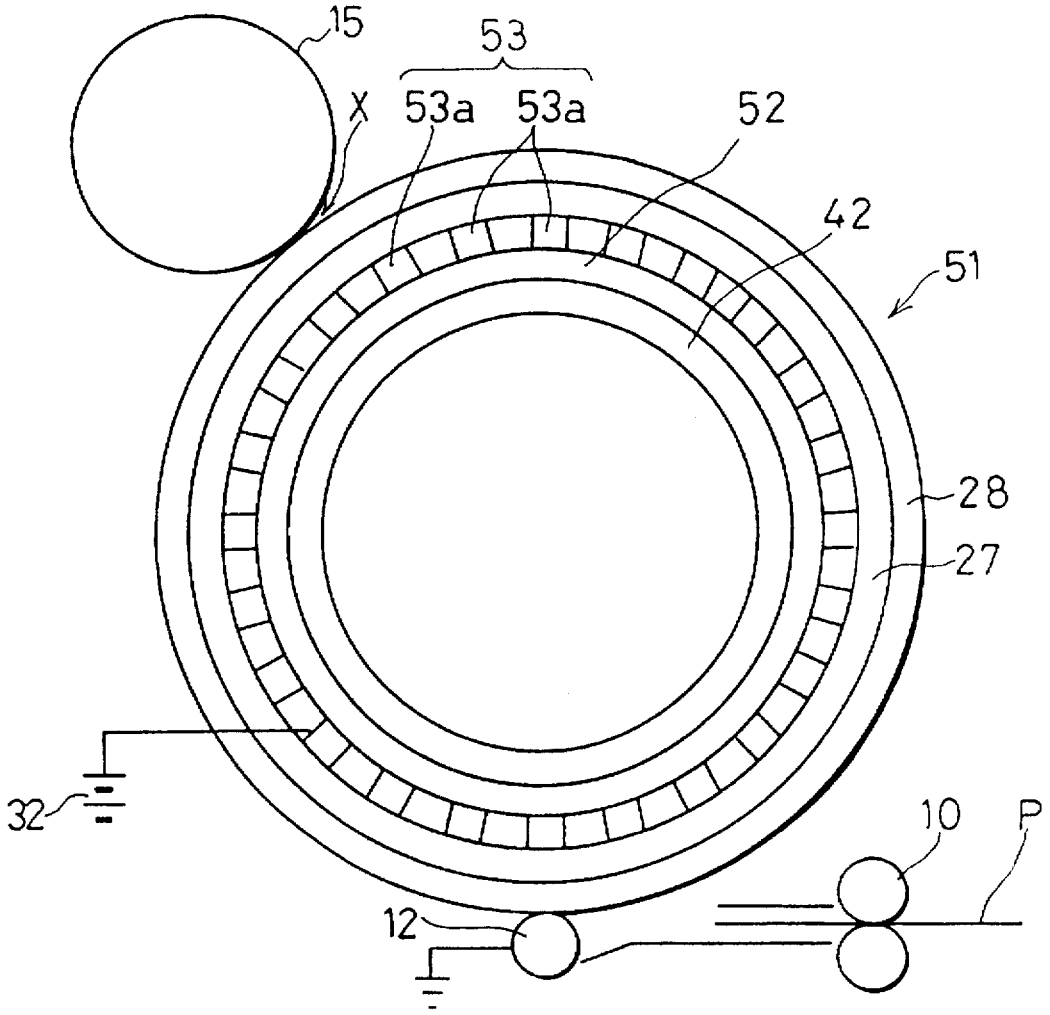
FIG. 19 is an explanatory view schematically showing the structure of an electrode layer of the transfer drum of FIG. 18.
Figure 20:
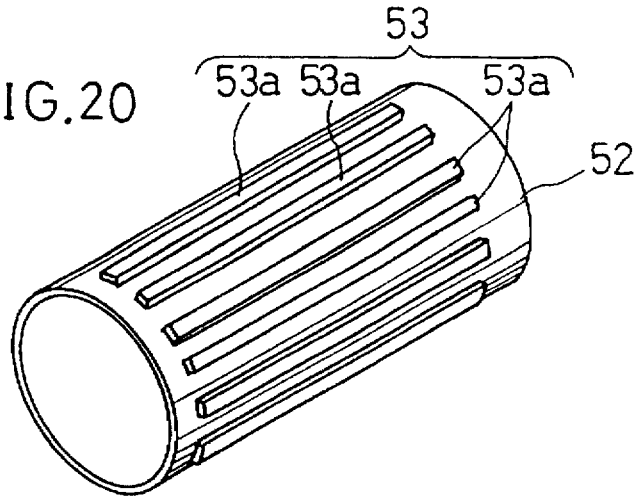
FIG. 20 is a perspective view showing the structure of the electrode layer of the transfer drum of FIG. 18.

Alternatively, it is possible to use the transfer drum 51 shown in FIG. 18 as another transfer drum having the semiconducting layer 27 and the dielectric layer 28. The transfer drum 51 uses the base member 42 of the transfer drum 41 as an inside base member. A semiconducting resilient layer 52 is formed on the surface of the base member 42. Moreover, as shown in FIGS. 19 and 20, formed on the outer surface of the resilient layer 52 is a noncontinuous electrode layer (conducting layer) 53 made of a plurality of conducting plates (conducting members) **53*a***, for example, copper plates or aluminum plates mounted at equal intervals.

Furthermore, the semiconducting layer 27 and the dielectric layer 28 are formed in this order on the outer surface of the electrode layer 53.

In this structure, like the transfer drums 11 and 41, by connecting the power source section 32 to the electrode layer 53 and applying a voltage, it is possible to stably induce charges on the surface of the dielectric layer 28 and achieve adhesion of the transfer material P to the transfer drum 51 and a transfer of the toner image in a stable manner.

In this case, it is also possible to obtain the same effect by connecting the power source section 32 to the semiconducting layer 27 and applying a voltage.

In the transfer drum 51 having the above-mentioned structure, since the electrode layer 53 is formed by the conducting plates 53a which are discontinuously mounted on the resilient layer 52, a lowering of voltage occurs on the electrode layer 53 only when the transfer drum 51 approaches the vicinity of the grounded conducting roller 12. Namely, since the respective conducting plates 53a are discrete, movements of charges among the conducting plates 53a do not occur, thereby preventing a lowering of voltage.

It is thus possible to prevent a lowering of voltage at the transfer position X, and eliminate an unsatisfactory transfer, improving the transfer efficiency and image quality.

Furthermore, as mentioned above, since the electrode layer 53 as the conducting layer is formed by simply mounting the conducting plates 53a at equal intervals on the surface of the base member 42, the cost of manufacturing the transfer drum 51 can be reduced, thereby achieving a reduction in the total cost of manufacturing the apparatus.

As described above, Embodiment 1 discusses mainly the structure of the conducting layer, the semiconducting layer and the dielectric layer in a transfer device such as a transfer drum, more particularly the relationship between the volume resistivity of the respective layers and the adhesion between the layers, and the electrostatic adhesion of the transfer material to the transfer drum. As is clear from Embodiment 1, with the use of the image forming apparatus of the present invention, it is possible to maintain a uniform surface potential of the transfer device such as a transfer drum in a stable manner, thereby eliminating unsatisfactory adhesion of the transfer material to the transfer device and unsatisfactory transfer of the toner image to the transfer material. As a result, an excellent image is formed on the transfer material.

However, it is possible to achieve a further improvement of the transfer efficiency and the image quality by changing the applied voltage depending on the type of the transfer material. The reason for this is that even if the same voltage is applied, the transfer efficiency varies depending on the type of the transfer material, for example, whether the transfer material is paper or an OHP sheet. The transfer efficiency also varies with humidity. Therefore, in order to achieve an optimum transfer efficiency, it is desirable to control the applied voltage according to the humidity.

Considering the relationship among the type of transfer material, humidity and the applied voltage, an image forming apparatus capable of achieving an optimum transfer efficiency will be discussed in Embodiment 2. The basic structure of Embodiment 2 is the same as Embodiment 1. The members having the same function as in Embodiment 1 will be designated by the same code and their description will be omitted. Transfer drums other than the above-mentioned transfer drum 11 are also applicable to Embodiment 2.

[EMBODIMENT 2]

The following description will discuss another embodiment of the present invention with reference to FIGS. 21 to 25.

Figure 21:
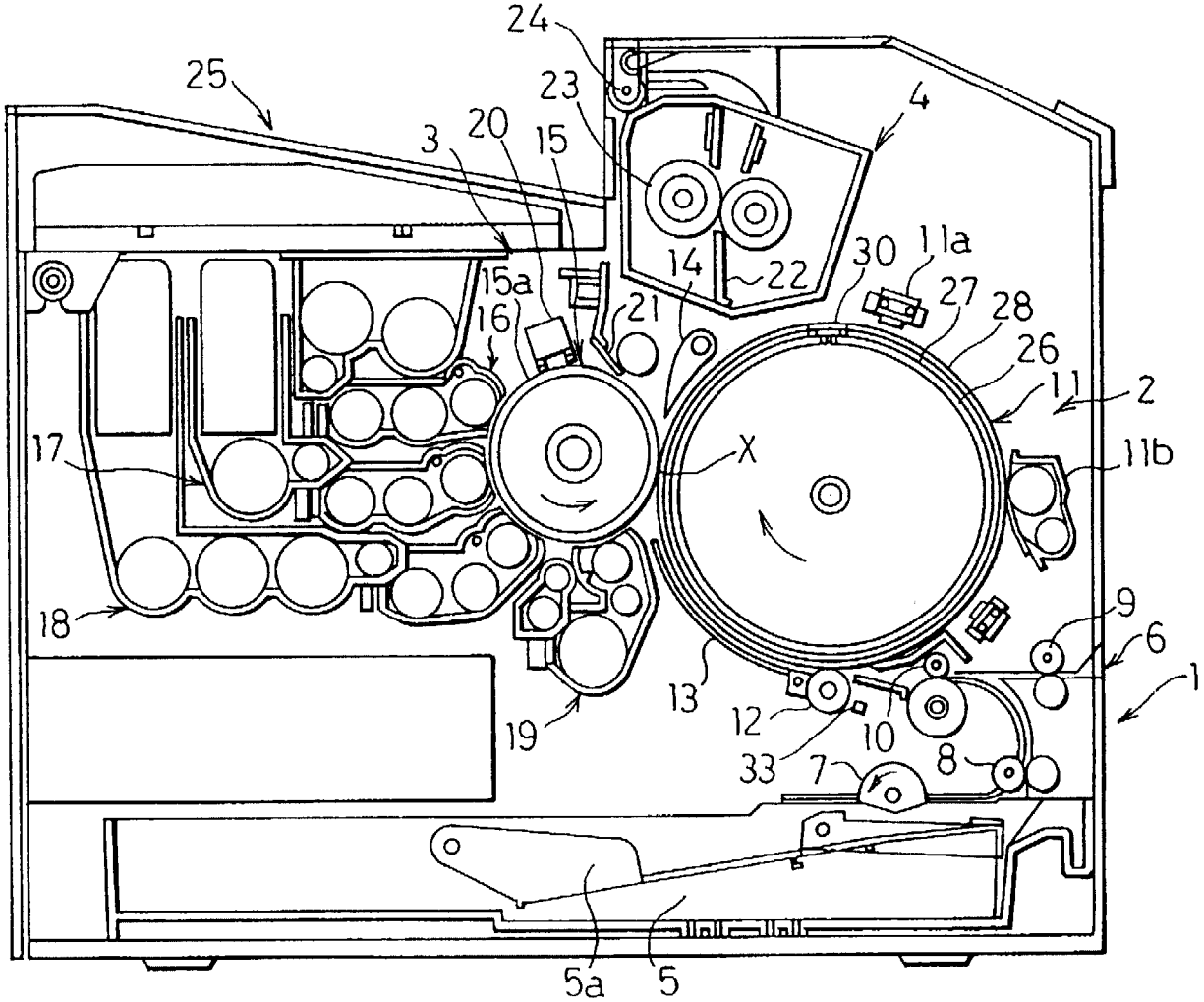
FIG. 21 schematically shows the structure of an image forming apparatus according to Embodiment 2 of the present invention.
Figure 22:
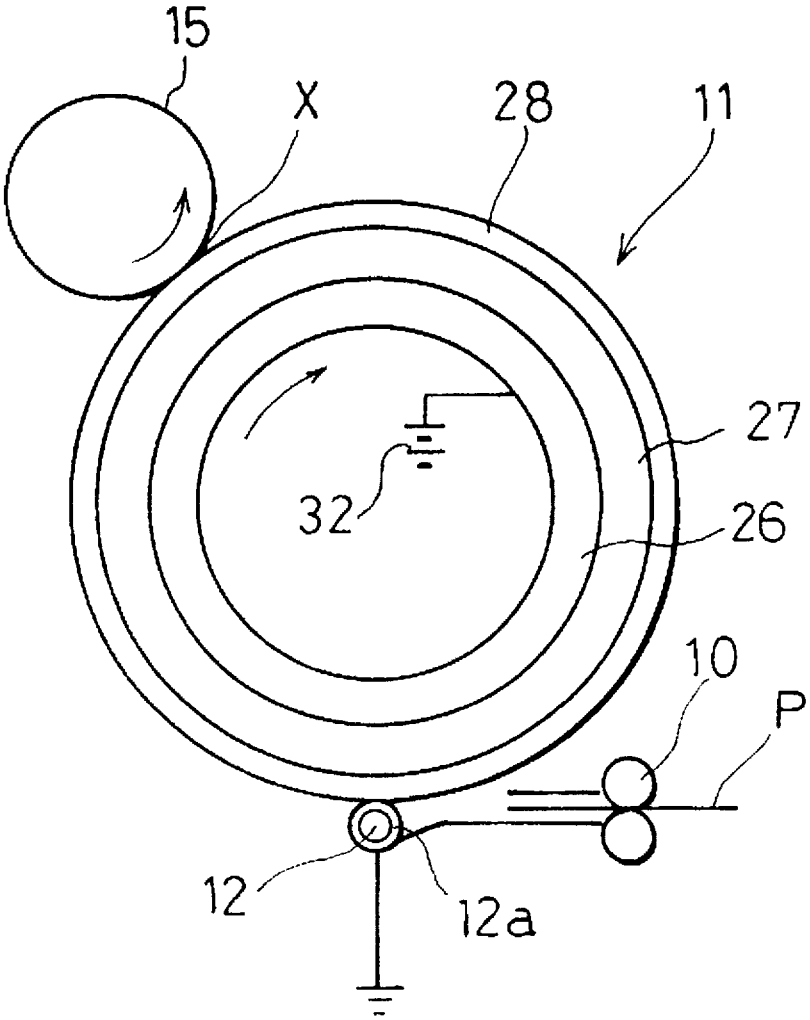
FIG. 22 schematically shows the structure near a transfer drum in the image forming apparatus of FIG. 21.

As illustrated in FIGS. 21 and 22, an image forming apparatus of this embodiment has the same structure as that of Embodiment 1. In this embodiment, the transfer drum 11 includes the conducting layer 26 made of a cylindrical aluminum as a base member, and the semiconducting layer 27 made of resilient urethane foam on the outer surface of the conducting layer 26. In addition, the dielectric layer 28 made of polyvinylidene fluoride (PVDF) is formed on the outer surface of the semiconducting layer 27. The power source section 32 as voltage applying means is connected to the conducting layer 26 so as to hold a stable voltage on the entire conducting layer 26. For example, the conducting layer 26, the semiconducting layer 27 and the dielectric layer 28 are fixed by the sheet holding plate 30 or a sheet holding member 31. However, it is not necessarily to limit the fixing method to the one mentioned above, and the respective layers may be fixed by other methods.

The power source section 32 is connected to the conducting layer 26, and the grounded conducting roller 12 is installed below the transfer drum 11. For example, as illustrated in FIG. 22, a charging layer 12a made of a electrifying material, which charges a transfer material P in a predetermined polarity before adhering to the transfer drum 11, may be formed on the surface of the conducting roller 12. With the formation of the charging layer 12a on the surface of the conducting roller 12, when the transfer material P passes through a section between the conducting roller 12 and the transfer drum 11, it produces friction upon contact with the charging layer 12a and is charged by the friction. At this time, the polarity of the charges on the transfer material P becomes opposite to the polarity of the voltage applied to the transfer drum 11.

It is possible to change the polarity of charges on the transfer material P by forming the charging layer 12a from a different material. For example, if the polarity of the voltage applied to the transfer drum 11 is positive, it is desirable to form the charging layer 12a from such a material that is capable of negatively charging the transfer material P. On the other hand, if the polarity of the voltage applied to the transfer drum 11 is negative, it is desirable to form the charging layer 12a from such a material that is capable of positively charging the transfer material P. In this case, in order to negatively charge the transfer material P, it is desirable to use such materials as glass and nylon as the charging layer 12a. On the contrary, in order to positively charge the transfer material P, it is desirable to form the charging layer 12a from, for example, "Teflon" that is a trade name for a certain fluoride resin.

Moreover, in order to improve the charging performance with respect to the transfer material P and the transfer efficiency, the surface of the charging layer 12a of the conducting roller 12 may be made slightly uneven.

Furthermore, since the transfer material P is charged by the charging layer 12a of the charging roller 12 upon contact with the transfer drum 11, it is possible to charge the transfer material P in a desired polarity irrespectively of the polarity of charges on the transfer material P. Therefore, even if the transfer material P has charges in the same polarity as the transfer drum 11 and is hard to adhere to the transfer drum 11 upon contact with the transfer drum 11, it is possible to charge the transfer material P in the desired polarity by simply bringing the transfer material into contact with the charging layer 12a to produce friction. As a result, the transfer material P can adhere to the transfer drum 11 in a stable manner.

The conducting roller 12 is pressed against the transfer drum 11 through the transfer material P upon the passage of the transfer material P through the section between the transfer drum 11 and the conducting roller 12. Thereafter, a voltage is applied to the transfer drum 11 to start charging of the transfer material P.

The charging of the transfer material P continues until one rotation of the transfer material P on the transfer drum 11 is completed. After charging the transfer material P, the conducting roller 12 is separated from the transfer drum 11.

Figure 23:
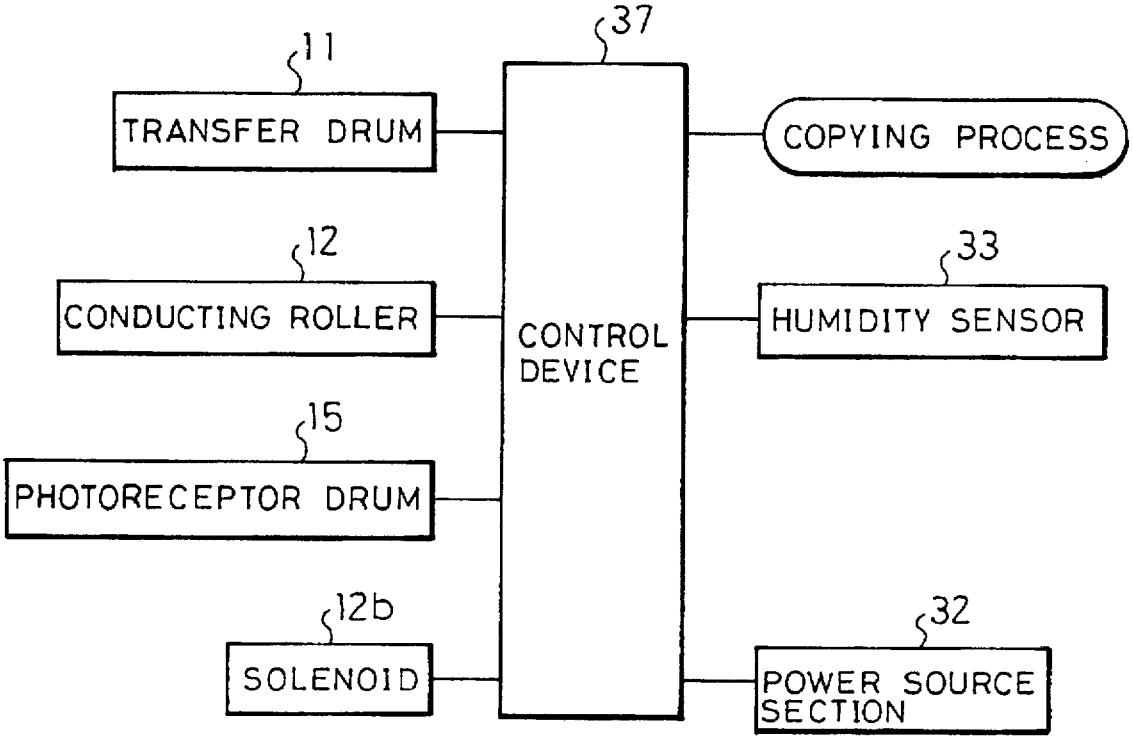
FIG. 23 is a block diagram of a control device in the image forming apparatus of FIG. 21.

Attaching and detaching the conducting roller 12 to/from the transfer drum 11 are mechanically carried out by placing a solenoid **12*b* as an electrode member on both ends of the axis of rotation of the conducting roller 12 (see FIG. 23). With this arrangement, the conducting roller 12** always provides a stable nip width.

The relationship between the nip width and the image quality are explained in Embodiment 1. In this embodiment, considering the transfer efficiency and the image quality, the transfer drum 11 and the photoreceptor drum 15 are also brought into contact with each other so that a pressure of 2 to 8 kg is applied to the transfer section.

In this embodiment, an image forming apparatus capable of achieving an optimum transfer efficiency will be discussed based on the relationship among the type of the transfer material P, humidity and the applied voltage. The structure for achieving the optimum transfer efficiency is explained below.

First, Table 6 shows the relationship between the volume resistivity of the semiconducting layer 27 and the image quality when, for example, the applied voltage and the volume resistivity of the dielectric layer 28 are 1000 V and $10^{13}$ Ω•cm, respectively.

TABLE 6

| Volume resistivity | $10^3$ | $10^4$ | $10^5$ | $10^6$ | $10^7$ | $10^8$ | $10^9$ | $10^{10}$ | $10^{11}$ |
|---|---|---|---|---|---|---|---|---|---|
| Image quality | x | x | x | Δ | Δ | Δ | ○ | ○ | x |
| | back transfer ←——→ unsatisfactory transfer | | | | | | | | |
| | unit: Ω · cm | | | | | | | | |

○: excellent, Δ: fair, x: unsatisfactory

As is clear from the results shown in Table 6 that when the applied voltage and the volume resistivity of the dielectric layer 28 are 1000 V and $10^{13}$ Ω•cm, respectively, if the volume resistivity of the semiconducting layer 27 is within a range of from $10^6$ Ω•cm to $10^{10}$ Ω•cm, an efficient transfer is achieved without causing back transfer or unsatisfactory transfer. More preferable results are obtained when the volume resistivity of the semiconducting layer 27 is within a range of from $10^9$ Ω•cm to $10^{10}$ Ω•cm.

It is thus possible to perform an efficient transfer and obtain an excellent image by setting the volume resistivity of the semiconducting layer 27 to $10^8$ Ω•cm as described above. The relationship between the volume resistivity and the image quality is not limited by the above-mentioned conditions, and similar effects are obtained when the applied voltage is within a range of from 1000 V to 2500 V.

In general, the dielectric layer 28 is required to have a high permittivity and charge holding power. Therefore, the dielectric layer 28 is formed by polyvinylidene fluoride, and the permittivity is set within a range between 8 and 12.

The amount of charge c on the dielectric layer 28 is given by $$c=\epsilon \cdot s/l$$

where c is the amount of charge, ε is the permittivity, s is the area of the dielectric layer 28, and l is the thickness thereof.

It is known from the equation that the amount of charge c is decreased and the transfer efficiency is improved as the permittivity ε becomes smaller. When the amount of charge c is decreased, the power for attracting the transfer material P also becomes smaller. It is also understood from the equation that the amount of charge c is increased and the transfer efficiency is lowered as the thickness of the dielectric layer 28 is reduced. When the amount of charge c becomes larger, the power for attracting the transfer material P is increased.

It is thus necessary to appropriately set the permittivity ε and the thickness l of the dielectric layer 28. The power of attracting the transfer material P and the transfer efficiency become appropriate when the dielectric layer 28 has a permittivity ε within a range between 8 and 12 and a thickness l within a range between 100 μm and 300 μm.

Then, with the use of paper and an OHP sheet of synthetic resin as the transfer material P, the relationship between the applied voltage and the transfer efficiency was studied when the volume resistivity of the semiconducting layer 27 is within a range of from $10^6$ Ω•cm to $10^{10}$ Ω•cm and the volume resistivity of the dielectric layer 28 is within a range of from $10^9$ Ω•cm to $10^{13}$ Ω•cm. The results are shown in Table 7. Here, 65 g paper whose weight per square meter is 65 grams was used as the paper.

TABLE 7

| semi-conducting layer | dielectric layer | | | | | | |
|---|---|---|---|---|---|---|---|
| volume resistivity | permea- | volume resistivity | type of transfer | transfer efficiency applied voltage (V) | | | |
| (Ω · cm) | bility | (Ω · cm) | material | 1000 | 1500 | 2000 | 2500 |
| $10^6$ | 11 | $10^9$ | paper | Δ | ○ | Δ | Δ |
| | | | OHP | Δ | Δ | ○ | ○ |
| | 11.1 | $10^{13}$ | paper | Δ | ○ | ○ | Δ |
| | | | OHP | Δ | ○ | ○ | ○ |
| $10^8$ | 11 | $10^9$ | paper | Δ | ○ | ○ | Δ |
| | | | OHP | Δ | Δ | Δ | ○ |
| | 11.1 | $10^{13}$ | paper | Δ | ○ | ○ | ○ |
| | | | OHP | Δ | Δ | ○ | ○ |
| $10^{10}$ | 11 | $10^9$ | paper | Δ | ○ | ○ | ○ |
| | | | OHP | ○ | ○ | ○ | ○ |
| | 11.1 | $10^{13}$ | paper | ○ | ○ | ○ | ○ |
| | | | OHP | ○ | ○ | ○ | Δ |

Δ: fair, ○: excellent

As is clear from the results shown in Table 7, when the OHP sheet is used as the transfer material P, the transfer efficiency does not substantially depend on the applied voltage irrespectively of the volume resistivity of the semiconducting layer 27 and the volume resistivity of the dielectric layer 28.

On the other hand, when paper is used as the transfer material P, the transfer efficiency is excellent if the applied voltage is within a range of from 1500 V to 2000 V. However, if the voltage is out of the range between 1000 V and 2500 V, the transfer efficiency sometimes becomes unsatisfactory.

Then, with the use of 65 g paper as the transfer material P, study was made by setting the volume resistivity of the semiconducting layer 27 within a range of from $10^6$ Ω•cm to $10^{10}$ Ω•cm and the volume resistivity of the dielectric layer 28 within a range of from $10^9$ Ω•cm to $10^{13}$ Ω•cm. It was found as a result of study that a transfer efficiency of 85% or higher transfer efficiency was achieved when the optimum applied voltage is decided as shown in Table 8. Assuming that the transfer efficiency is 100 percent when the toner is completely transferred to the paper, a transfer efficiency of 85% means that 85 percent of the toner is transferred to the paper and some toner residues on the photoreceptor drum 15.

TABLE 8

| applied voltage (V) | 1000< | 1000 | 1200 | 1500 | 1700 | 2000 | 2500 | 2500< |
|---|---|---|---|---|---|---|---|---|
| transfer efficiency | x | Δ | Δ | o | o | o | Δ | x |

x: unsatisfactory, Δ: fair, o: excellent

It was found from the results shown in FIG. 8 that when the paper is used as the transfer material P, the transfer of toner is performed efficiently by setting the applied voltage within a range of from 1000 V to 2500 V, and that a more preferable result is obtained by setting the applied voltage within a range of from 1500 V to 2000 V.

Moreover, the same experiment was performed by using different papers whose weight per square meter is within a range of from 65 g to 128 g. The same results as those shown in Table 8 were obtained.

As described above, even when the same voltage is applied to the conducting layer 26, the transfer efficiency varies depending on the type of the transfer material P. Therefore, by changing the applied voltage depending on the type of the transfer material P, it is possible to always perform an efficient transfer. When the transfer material P is paper, the transfer efficiency can be significantly improved by applying a voltage within a range of 1000 V to 2500 V to the transfer drum 11 having the semiconducting layer 27 whose volume resistivity is within a range of from $10^6$ Ω•cm to $10^{10}$ Ω•cm and the dielectric layer 28 whose volume resistivity is within a range of from $10^9$ Ω•cm to $10^{13}$ Ω•cm.

Moreover, if the volume resistivity of the semiconducting layer 27 is within a range of from $10^6$ Ω•cm to $10^{10}$ Ω•cm and the volume resistivity of the dielectric layer 28 is within a range of from $10^9$ Ω•cm to $10^{13}$ Ω•cm, an efficient transfer is achieved by applying a voltage ranging from 1000 V to 2500 V to the transfer drum 11 irrespectively of whether the transfer material P is paper or the OHP sheet. In short, when the volume resistivity of the semiconducting layer 27 and the volume resistivity of the dielectric layer 28 are within the above-mentioned ranges, an efficient transfer is achieved by applying a voltage ranging from 1000 V to 2500 V to the transfer drum 11 without switching the voltage depending on the type of the transfer material P.

However, even if the same voltage is applied, the transfer efficiency varies depending on the humidity at the time of transfer. More specifically, even if the same voltage is applied to the conducting layer 26, the transfer efficiency varies because the volume resistivities of the semiconducting layer 27, the dielectric layer 28 and the transfer material P change depending on the humidity. It is thus necessary to apply an optimum voltage to the conducting layer 26 according to the humidity.

In order to detect the humidity at the time of transfer, as illustrated in FIG. 22, a humidity sensor (hygrometer) 33 as humidity detecting means is installed in the vicinity of the transfer drum 11. By reading the humidity with the humidity sensor 33 before the adhesion of the transfer material P and then deciding the applied voltage, the power source section 32 applies an optimum voltage to the conducting layer 26 according to the humidity.

In this case, in order to achieve an efficient transfer, it is necessary to decrease the applied voltage as the humidity increases. However, if the applied voltage is set too low when the humidity is high, the adhesion of paper is weakened, resulting in an unsatisfactory transfer. Considering such a fact, when the volume resistivity of the semiconducting layer 27 is within a range of from $10^6$ Ω•cm to $10^{10}$ Ω•cm and the volume resistivity of the dielectric layer 28 is within a range of from $10^9$ Ω•cm to $10^{13}$ Ω•cm, the optimum applied voltage is decided as shown in Table 9 with respect to the degree of humidity.

TABLE 9

| humidity (%) | applied voltage (V) |
|---|---|
| 0–40 | 1000–2000 |
| 41–60 | 1000–2500 |
| 61–80 | 1500–2500 |
| 81–100 | 1500–2000 |

As shown in Table 9, when the humidity is within a range of from 0% to 40%, the applied voltage is preferably within a range of from 1000 V to 2000 V. When the humidity is within a range of from 41% to 60%, the applied voltage is preferably within a range of from 1000 V to 2500 V. When the humidity is within a range of from 61% to 80%, the applied voltage is preferably within a range of from 1500 V to 2500 V. When the humidity is within a range of from 81% to 100%, the applied voltage is preferably within a range of from 1500 V to 2000 V. If the applied voltage is within the above-mentioned ranges, an efficient transfer is performed. The most efficient transfer is carried out by setting the applied voltage to a medium value within the above-mentioned ranges.

Figure 24:
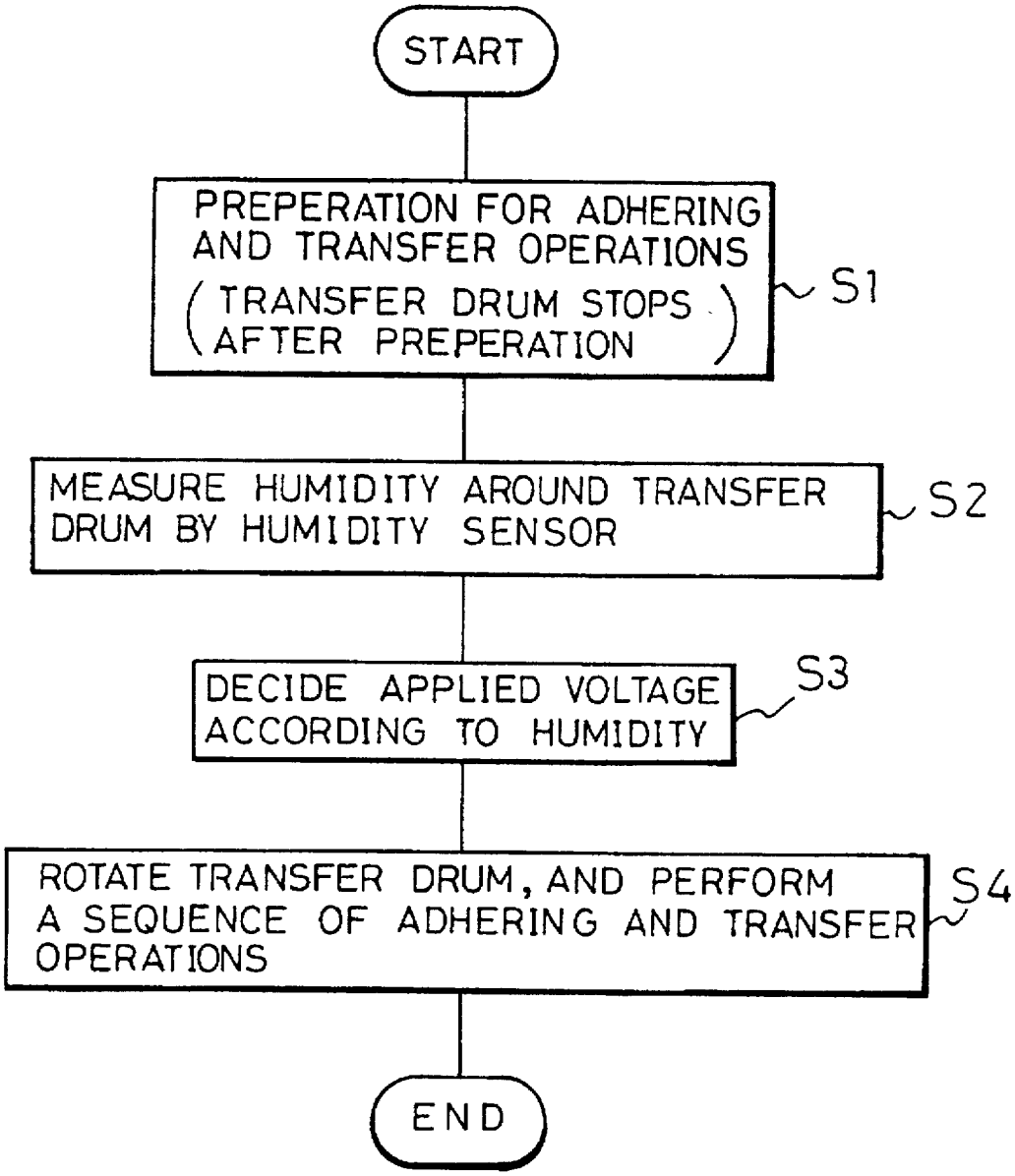
FIG. 24 is a flow chart showing the control of the application of a voltage to the transfer drum in the image forming apparatus of FIG. 21 using a humidity sensor.

Referring now to the flow chart of FIG. 24, the following description will discuss the control of the application of voltage to the transfer drum 11 using the humidity sensor 33. In this case, the following members are controlled by a control device 37 shown in FIG. 23.

First, when a power source switch (not shown) of the main body is turned on, preparation for the paper adhering and transfer operations, for example, cleaning and removal of charges, is performed (step 1). After the preparation, the transfer drum 11 stops. Subsequently, the humidity around the transfer drum 11 is detected by the humidity sensor 33 (step 2), and an applied voltage is decided according to the detected humidity (step 3). In this case, when the detected humidity is within a range of from 0% to 40%, the applied voltage is set within a range of 1000 V to 2000 V. When the detected humidity is within a range of from 41% to 60%, the applied voltage is set within a range of 1000 V to 2500 V. When the detected humidity is within a range of from 61% to 80%, the applied voltage is set within a range of 1500 V to 2500 V. When the detected humidity is within a range of from 81% to 100%, the applied voltage is set within a range of 1500 V to 2000 V. Thereafter, the transfer drum 11 is rotated to perform a sequence of paper adhering and transfer operations (step 4). The adhesion of the transfer material P such as paper to the transfer drum 11 and the transfer of the toner image are performed in the manner mentioned in Embodiment 1.

As described above, by detecting the humidity with the humidity sensor 33 before the transfer material P adheres to the transfer drum 11 and applying the optimum voltage corresponding to the humidity from the power source section 32 to the conducting layer 26, it is possible to always achieve the optimum transfer efficiency under various humidity conditions. In particular, when the transfer material P is paper, the transfer efficiency varies depending on the applied voltage because the paper is easily affected by the humidity. The transfer efficiency can be improved further by applying from the power source section 32 to the conducting layer 26 a voltage according to the result of the detection made by the humidity sensor 33.

In this embodiment, the cylindrical aluminum is used as the conducting layer 26. However, it is also possible to use other conducting body. Although the semiconducting layer 27 is formed by urethan foam, it is possible to use other semiconducting resilient body, for example, silicone. Moreover, although the dielectric layer 28 is formed by polyvinylidene fluoride, it is possible to use other dielectric resin, for example, polyethylene terephthalate.

Figure 25:
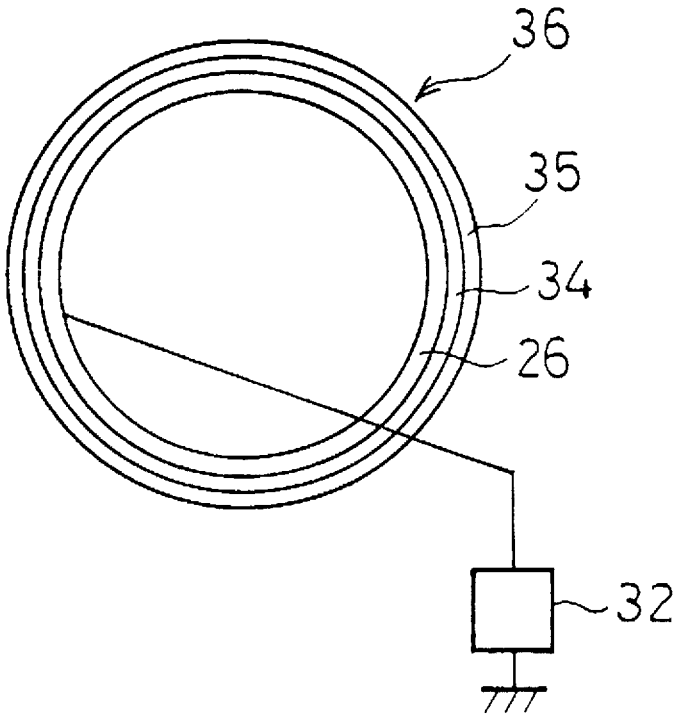
FIG. 25 is an explanatory view showing another structure of the transfer drum of FIG. 22.
Figure 26:
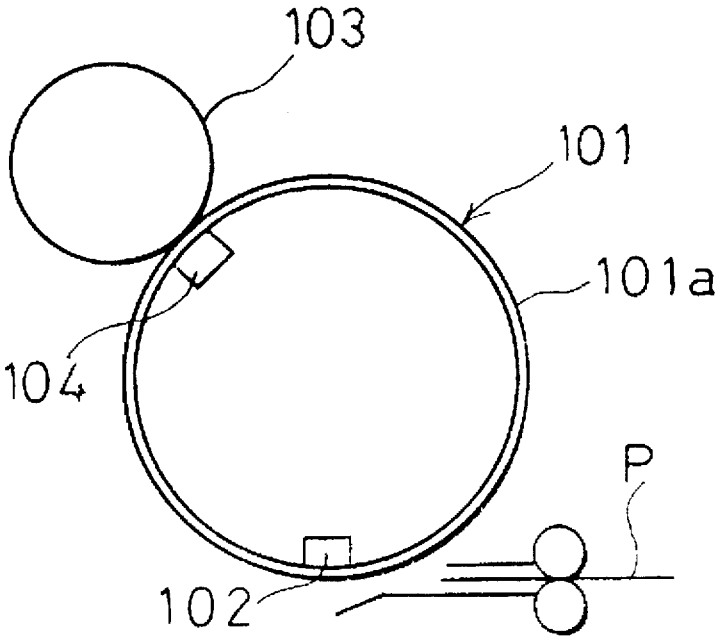
FIG. 26 schematically shows the structure of a conventional image forming apparatus.
Figure 27:
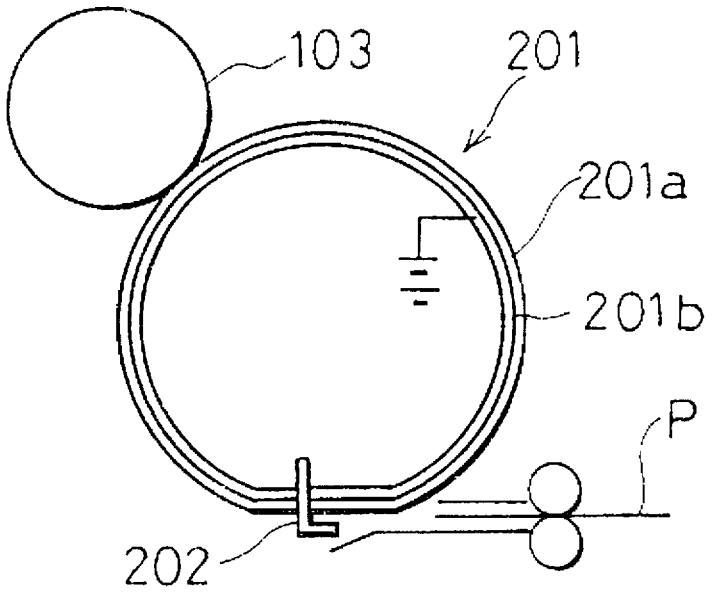
FIG. 27 schematically shows the structure of another conventional image forming apparatus.

Furthermore, as shown in FIG. 25, it is also possible to use a transfer drum 36 including the conducting layer 26, a semiconducting film 34 as a semiconducting layer having permittivity and resistivity equivalent to the semiconducting layer 27 of the transfer drum 11, and a dielectric film 35 as a dielectric layer having permittivity and resistivity equivalent to the dielectric layer 28, instead of the transfer drum 11. The conducting layer 26, the semiconducting film 34, and the dielectric film 35 are formed in this order from inside toward outside. In this case, a voltage is also applied to the conducting layer 26 from the power source section 32.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

an image carrying body on which a toner image is to be formed;

transferring means for transferring a toner image formed on said image carrying body to a transfer material by bringing the transfer material into contact with said image carrying body, said transferring means having a dielectric layer, a semiconducting layer and a conducting layer laminated in this order from a contact side which comes into contact with the transfer material;

voltage applying means, connected to said conducting layer, for applying a predetermined voltage to said conducting layer; and potential difference generating means which is grounded, disposed on an upstream section in a transporting direction of the transfer material with respect to a transfer position on a surface of said dielectric layer, and comes into contact with the surface of said dielectric layer through the transfer material, wherein a volume resistivity of said dielectric layer is not lower than 40 percent of a volume resistivity of said semiconducting layer.

2. The image forming apparatus according to claim 1, wherein the volume resistivity of said dielectric layer is within a range of from $10^9$ Ω•cm to $10^{15}$ Ω•cm.

3. The image forming apparatus according to claim 1, wherein the volume resistivity of said semiconducting layer is within a range of from $10^6$ Ω•cm to $10^{11}$ Ω•cm.

4. The image forming apparatus according to claim 1, wherein the volume resistivity of said semiconducting layer is within a range of from $10^8$ Ω•cm to $10^{11}$ Ω•cm.

5. The image forming apparatus according to claim 1, further comprising pre-curling means for curling the transfer material supplied between said transferring means and said potential difference generating means along a surface shape of said transferring means.

6. The image forming apparatus according to claim 1, further comprising cleaning means for cleaning a surface of said transferring means.

7. The image forming apparatus according to claim 1, further comprising charge removing means for removing residual charges on said transferring means.

8. The image forming apparatus according to claim 1, wherein said semiconducting layer is formed by a resilient semiconducting substance.

9. The image forming apparatus according to claim 1, wherein said semiconducting layer is formed by a urethane foam or silicone.

10. The image forming apparatus according to claim 1, wherein said semiconducting layer is urethane foam produced by foam-molding urethane directly on said conducting layer.

11. The image forming apparatus according to claim 1, wherein said dielectric layer is formed by polyvinylidene fluoride or polyethylene terephthalate.

12. The image forming apparatus according to claim 11, wherein said dielectric layer is a cylindrical seamless thin film sheet of polyvinylidene fluoride adhesively fixed on said semiconducting layer by thermal shrinkage.

13. The image forming apparatus according to claim 1, wherein said dielectric layer, said semiconducting layer and said conducting layer are adhesively fixed by a conducting adhesive agent.

14. The image forming apparatus according to claim 1, wherein a width of said conducting layer and a width of said dielectric layer are equal to each other, and a width of said semiconducting layer is smaller than the width of said dielectric layer.

15. An image forming apparatus comprising:

an image carrying body on which a toner image is to be formed;

transferring means for transferring a toner image formed on said image carrying body to a transfer material by bringing the transfer material into contact with said image carrying body, said transferring means having a dielectric layer, a semiconducting layer and a conducting layer laminated in this order from a contact side thereof which comes into contact with the transfer material;

voltage applying means, connected to said conducting layer, for applying a predetermined voltage to said conducting layer; and potential difference generating means which is grounded, disposed on an upstream section in a transporting direction of the transfer material with respect to a transfer position on a surface of said dielectric layer, and comes into contact with the surface of said dielectric layer through the transfer material, wherein said dielectric layer, said semiconducting layer, and said conducting layer adhere to each other without a cavity therebetween, and said dielectric layer and said semiconducting layer are formed as an integrally molded two-layer polymer film sheet.

16. The image forming apparatus according to claim 15, wherein said semiconducting layer is urethane foam produced by foam-molding urethane directly on said conducting layer.

17. The image forming apparatus according to claim 15, wherein said dielectric layer is a cylindrical seamless thin film sheet of polyvinylidene fluoride adhesively fixed on said semiconducting layer by thermal shrinkage.

18. An image forming apparatus comprising:

an image carrying body on which a toner image is to be formed;

transferring means for transferring a toner image formed on said image carrying body to a transfer material by bringing the transfer material into contact with said image carrying body, said transferring means having a dielectric layer, a semiconducting layer and a conducting layer laminated in this order from a contact side thereof which comes into contact with the transfer material;

voltage applying means, connected to said conducting layer, for applying a predetermined voltage to said conducting layer; and potential difference generating means which is grounded, disposed on an upstream section in a transporting direction of the transfer material with respect to a transfer position on a surface of said dielectric layer, and comes into contact with the surface of said dielectric layer through the transfer material, wherein said voltage applying means applies a voltage ranging from 1000 V to 2500 V to said transferring means when a volume resistivity of said semiconducting layer is within a range of from $10^6$ Ω•cm to $10^{10}$ Ω•cm and a volume resistivity of said dielectric layer is within a range of from $10^9$ Ω•cm to $10^{13}$ Ω•cm.

19. The image forming apparatus according to claim 18, wherein said transfer material is paper.

20. The image forming apparatus according to claim 18, further comprising humidity detecting means for detecting humidity in the vicinity of said transferring means, and wherein said voltage applying means applies to said conducting layer a voltage according to a result of a detection made by said humidity detecting means.

21. The image forming apparatus according to claim 20, wherein said voltage applying means applies a voltage ranging from 1000 V to 2000 V when the humidity is within a range of from 0 percent to 40 percent.

22. The image forming apparatus according to claim 20, wherein said voltage applying means applies a voltage ranging from 1000 V to 2500 V when the humidity is within a range of from 41 percent to 60 percent.

23. The image forming apparatus according to claim 20, wherein said voltage applying means applies a voltage ranging from 1500 V to 2500 V when the humidity is within a range of from 61 percent to 80 percent.

24. The image forming apparatus according to claim 20, wherein said voltage applying means applies a voltage ranging from 1500 V to 2000 V when the humidity is within a range of from 81 percent to 100 percent.

25. The image forming apparatus according to claim 20, further comprising pre-curling means for curling the transfer material supplied between said transferring means and said potential difference generating means along a surface shape of said transferring means.

26. The image forming apparatus according to claim 18, further comprising cleaning means for cleaning a surface of said transferring means.

27. The image forming apparatus according to claim 18, further comprising charge removing means for removing residual charges on said transferring means.

28. The image forming apparatus according to claim 18, wherein said potential difference generating means includes thereon a charging layer made of a charging member for charging the transfer material in a polarity opposite to a charging polarity of said transferring means.

29. The image forming apparatus according to claim 18, wherein said potential difference generating means has an uneven surface.

30. The image forming apparatus according to claim 18, further comprising potential difference generating means driving means for bringing said potential difference generating means and said transferring means into contact with each other or separating said potential difference generating means and said transferring means from each other.

* * * * *